US011095993B2

(12) United States Patent
Han

(10) Patent No.: US 11,095,993 B2
(45) Date of Patent: Aug. 17, 2021

(54) SOUND ANCHOR FOR TRANSMITTING SOUND AND VIBRATION TO HUMAN TISSUES IN EAR CANAL AND SEMI-IMPLANTABLE HEARING AID HAVING THE SAME

(71) Applicant: SAFAUD Inc., Changwon-si (KR)

(72) Inventor: Chang Yong Han, Changwon-si (KR)

(73) Assignee: SAFAUD INC., Changwon-si (KR)

( * ) Notice: Subject to any disclaimer, the term of this patent is extended or adjusted under 35 U.S.C. 154(b) by 28 days.

(21) Appl. No.: 16/706,217

(22) Filed: Dec. 6, 2019

(65) Prior Publication Data

US 2021/0051424 A1 Feb. 18, 2021

(30) Foreign Application Priority Data

Aug. 13, 2019 (KR) ..... 10-2019-0098741

(51) Int. Cl.
*H04R 25/00* (2006.01)

(52) U.S. Cl.
CPC ..... *H04R 25/604* (2013.01); *H04R 2225/67* (2013.01)

(58) Field of Classification Search
CPC ..... H04R 25/606; H04R 25/556
See application file for complete search history.

(56) References Cited

U.S. PATENT DOCUMENTS 4,756,312 A * 7/1988 Epley ..... H04R 25/606 607/57
6,137,889 A * 10/2000 Shennib ..... H04R 25/456 181/130
6,139,488 A * 10/2000 Ball ..... A61F 2/18 600/25
6,190,305 B1 2/2001 Ball et al.
6,940,989 B1 * 9/2005 Shennib ..... H04R 25/606 381/326
8,641,596 B2 * 2/2014 Meskens ..... H04R 25/554 600/25

(Continued)

FOREIGN PATENT DOCUMENTS

EP 1243163 A1 9/2002
EP 3001700 A1 3/2016

(Continued)

*Primary Examiner* — Ryan Robinson
(74) *Attorney, Agent, or Firm* — STIP Law Group, LLC

(57) ABSTRACT

A sound anchor for transmitting a sound and vibration to human tissues in an ear canal is provided. The sound anchor includes a first link, and an anchor which is fixed to an ear canal inner wall of a user, receives the sound and vibration from the first link, and transmits the sound and vibration to at least one of an ear canal bone portion, a bone portion skin surface, and an auditory ossicle protrusion portion of an eardrum. The anchor includes a bar-shaped connection portion and an ear canal contact portion which is installed in the connection portion. The ear canal contact portion includes a first contact portion which is installed in one end portion of the connection portion and is in contact with the skin surface or the bone portion, and a second contact portion which is installed in the other end portion of the connection portion and is in contact with the skin surface or the bone portion. The first link is attachable to or detachable from the anchor.

17 Claims, 25 Drawing Sheets

(56) References Cited

U.S. PATENT DOCUMENTS

| | | | | |
|---|---|---|---|---|
| 2001/0027342 | A1* | 10/2001 | Dormer | A61F 2/18 623/10 |
| 2002/0062059 | A1* | 5/2002 | Waldmann | H04R 25/70 600/25 |
| 2009/0245556 | A1 | 10/2009 | Parker et al. | |
| 2013/0116497 | A1* | 5/2013 | Vermeiren | H04R 25/606 600/25 |
| 2015/0010185 | A1* | 1/2015 | Puria | H04R 25/65 381/328 |
| 2016/0094922 | A1* | 3/2016 | Ollgaard | H04R 25/604 600/25 |
| 2018/0213331 | A1 | 7/2018 | Rucker et al. | |
| 2018/0319863 | A1 | 11/2018 | Hildebrand et al. | |
| 2020/0135215 | A1* | 4/2020 | Larkin | H04R 25/55 |
| 2020/0389741 | A1* | 12/2020 | Agac | H04R 25/556 |

FOREIGN PATENT DOCUMENTS

| | | | |
|---|---|---|---|
| JP | 2003520004 | A | 6/2003 |
| JP | 2004166174 | A | 6/2004 |
| JP | 2004187953 | A | 7/2004 |
| JP | 2005533453 | A | 11/2005 |
| JP | 2008252876 | A | 10/2008 |
| KR | 100229086 | B1 | 11/1999 |
| KR | 1020090076484 | A | 7/2009 |
| KR | 1020100005940 | A | 1/2010 |
| KR | 1020150049899 | A | 5/2015 |
| WO | WO0150815 | A1 | 7/2001 |

* cited by examiner

SOUND ANCHOR FOR TRANSMITTING SOUND AND VIBRATION TO HUMAN TISSUES IN EAR CANAL AND SEMI-IMPLANTABLE HEARING AID HAVING THE SAME

CROSS-REFERENCE TO RELATED APPLICATIONS

This application claims the priority of the Korean Patent Applications No. 10-2019-0098741 filed on Aug. 13, 2019, in the Korean Intellectual Property Office, the disclosure of which is incorporated herein by reference.

TECHNICAL FIELD

The present disclosure relates to a sound anchor for transmitting a sound to human tissues in an ear canal and a semi-implantable hearing aid having the sound anchor. More specifically, the present disclosure relates to a technology for providing hearing to a user through transmission of a sound or a vibration of a sound anchor which is in contact with a skin or bone tissues in an ear canal or an eardrum and an auditory ossicle of the user.

BACKGROUND ART

Due to an increase in elderly population and a noise environment, hearing loss patients increase. Recently, there have been various technological developments in a field of a hearing aid. In particularly, an open type hearing aid is widely used due to a development in a digital technology such as a feedback removal technology, and speech comprehension is improved in a noisy situation due to a noise removal technology. In addition, a size of the hearing aid decreases, and, thus, a hearing loss patient can more easily wear the hearing aid. However, since a sound transmission method such as air conduction is used, problems such as an acoustic feedback, a closing effect due to an ear mold, an insufficient gain at a high frequency, and nonlinear distortion are still difficult to solve. Moreover, there are still various problems such as stimulation of the ear canal, discomfort due to wearing of the hearing aid, and a difficulty in the wearing of the hearing aid when otorrhea occurs. In order to solve the problems, research and development of sound transmission methods such as various bone conduction, various eardrum conduction, and middle ear implantation have been conducted. The experiment of vibrating the eardrum with iron particles was conducted in 1935. With the experiment as momentum, in late 1950s, a research into the installation of an intersecting magnetic field in the eardrum was carried out in earnest. These early attempts were a basis for future studies evaluating clinical viability of an implantable bone conduction hearing aid. Lab-only studies slowly moved to a clinical site. As a result, a direct bone conduction method succeeded in 1977, and in 1981, a hearing aid was directly attached to a temporal lobe to provide an acoustic gain of about 15 dB. Based on a logic that, in the bone conduction stimulation transmission method, the sound is effectively transmitted as the implantable bone conduction hearing aid approaches a cochlea, in 1995, the implantable bone conduction hearing aid was inserted about 55 mm deep of a mastoid. In 2001, the U.S. Food and Drug Administration confirmed that the implantable bone conduction hearing aid is clinically effective in recognizing a sound source or determining a location of the sound source in a background noise, and approved bilateral implantation. Moreover, in following year, in September 2002, the U.S. Food and Drug Administration approved implantation of a bone conduction hearing aid for a patient with single sided deafness (SSD). In Korea, beginning with first implantation in 2005, the number of surgeries has steadily increased. However, the implanted bone conduction hearing aid continuously compresses the mastoid. Accordingly, discomforts such as a pain of an attachment, skin stimulation, and headache are generated, and a disadvantage such as instability of the attachment frequently occurs. As a solution with respect to these problems, recent efforts have been made to develop a subcutaneous implantable bone conduction hearing aid and a middle ear implantable hearing aid. Compared with the existing implantable bone conduction bearing aid, the subcutaneous implantable bone conduction bearing aid is comfortable to wear, easy to use, and aesthetically pleasing without secondary inflammation of an outer ear. In addition, the middle ear implantable hearing aid directly stimulates the auditory ossicle without going through the skin or soft tissues to transmit a sound, and, thus, a user can hear the sound relatively comfortably. That is, after a sound received through a transmitter is appropriately amplified according to a hearing threshold of a patient, a signal is transmitted to a vibration transducer implanted in the middle ear to generate a vibration signal, and, thus, the user recognizes the sound. Accordingly, the bone conduction or the sound stimulation due to the implantation of the middle ear is directly transmitted to a cochlea without passing through the ear canal and the middle ear, or a portion of the middle ear. Therefore, a result of a hearing recovery is largely dependent on a function of the cochlea of the patient. In other words, since the sound does not go through an ear canal path during the transmission of the sound, there is no sound feedback phenomenon. Moreover, since excessive amplification is not used, there is little sound distortion. Moreover, since frequency characteristics of the sound are transmitted to an inner ear without any damage, speech intelligibility is also superior to an airway conduction hearing aid. The implantable bone conduction hearing aid is a hearing recovery means for directly attaching the hearing aid to a skull to improve auditory acuity. In the implantable bone conduction hearing aid, the auditory acuity can be improved regardless of existence or absence of an eardrum and an auditory ossicle of a patient, and it is possible to improve attenuation caused by skin or subcutaneous soft tissues, which is a disadvantage of the existing bone conduction hearing aid. Accordingly, the implantable bone conduction hearing aids have been considered as a useful alternative for a patient with chronic otitis media or a patient with difficulty in wearing the airway conduction hearing aid due to deformities of an outer ear. In addition, for a unilateral hearing loss patient, the implantable bone conduction hearing aid receives stimulation from an ear having a hearing loss and transmits the sound in a bone conduction method through a skull vibration. Accordingly, an effect of a contralateral routing of signal (CROS) is exerted, that is, the sound is transmitted to an opposite ear having an intact function of a cochlea, and, thus, a head shadow effect is minimized. However, the implantable hearing aid requires a lot of time in clinical trials, and a high cost of surgery is a great burden for a patient to select the implantable hearing aid. In addition, there is a disadvantage that MRI cannot be performed because the hearing aid should be inserted into a human body through a surgical method. Specifically, since the existing skin attachment method known as an Adhear brand is a band-aid type method, the skin attachment method is simple. However, attenuation of 20 dB occurs, and it is known that there is a limit to transmitting a high quality sound. In addition, there are BAHA and Sound Bridge brand products as the implantable hearing aid. However, there are medical legal limitations and material stability issues in these products, surgery is required for the products, the products are very expensive, and, thus, an average consumer cannot easily use the products. In addition, in the bone conduction method through the existing ear canal, only a cartilage is stimulated, and, thus, a quality of a sound transmission decreases.

Different types of hearing aids are available for each patient's condition, and each has advantages and disadvantages. Accordingly, since there is no view that a particular kind of hearing aid is mainstream, as a lot of researches and developments have been conducted for each of the various types of hearing aids, many companies which manufacture the hearing aids and research institutes have filed many patents related to the research.

For example, a hybrid hearing device disclosed in KR2013-0131057 has a vibrating portion which can be in contact with a skin in an ear canal, and provides a bone conduction sound through a bone in the ear canal using the vibrating portion. In addition, a technology disclosed in JP2002-311872 which is related to an insertion bone conduction receiver in an ear canal and an insertion bone conduction hearing aid in the ear canal is a technology of inserting a bone conduction receiver into the ear canal to increase efficiency of bone conduction hearing and transmitting the vibration through an ear canal inner wall. Moreover, U.S. Ser. No. 12/168,603 discloses a hearing device having one or more in-the-canal vibrating extensions in which a pulsating extension is attached to a skin surface in the ear canal so as to transmit a vibration. However, in the technologies of the related art described above, wearing these devices is uncomfortable due to the vibration portion closing an inside of the ear canal and inconvenience occurs due to the closing effect. In addition, the skin in the ear canal is damaged due to repeated frictions between the extension and the skin in the ear canal when the hearing aid is attached and detached.

Meanwhile, as described above, the experiment of vibrating the eardrum with iron particles was conducted in 1935 to further increase efficiency of the sound transmission. With the experiment as momentum, in late 1950s, a research into the installation of an intersecting magnetic field in the eardrum was carried out in earnest. In this way, there have been many technology developments related to the technology of directly stimulating the eardrum. For example, in a contact vibrator and a hearing device using the same disclosed in JP2008-039517, a vibration is directly transmitted to an eardrum using a tip which can be in contact with the eardrum, and it is possible to correspond to a length in a path in an ear canal by adjusting a position of the tip. In addition, a direct tympanic drive via a floating filament assembly disclosed in EP2000-990232 relates to a device that includes a pad attached to an eardrum and a shaft connected to the pad, and transmits a vibration to the shaft. In the above-described technologies, the vibration is directly transmitted to the eardrum, and, thus, transmission efficiency of the sound is high. However, it is necessary to cause the tip from the hearing aid to come into contact with the eardrum every time a user wears the hearing aid. Accordingly, pain occurs due to a contact between the tip and the eardrum, the eardrum is damaged due to an excessive force applied to the tip during the wearing of the hearing aid, which is considered as a fatal limit.

In addition, technologies have been introduced for additional devices for inducing the device, such as the tip that transmits vibration directly to the eardrum, to accurately contact the eardrum. For example, a hearing aid disclosed in JP2004-187953 includes a conduit holding member for directly transmitting the vibration to the eardrum and stably fixing a protractor for directly the vibration to the ear canal. In a positioned hearing system disclosed in EP2015-187326, an insertion portion is fixed using an anchor pin, and a vibration is directly transmitted to an eardrum using a hammer extruded from the insertion portion. In above-described related arts, the protractor or the insertion portion is guided so as to correctly reach a contact point of the eardrum. However, the following problems still occur. That is, a pin occurs due to the hearing aid coming into contact with the eardrum every time the user wears the hearing aid, and the eardrum and the auditory ossicle are damaged due to an excessive force being applied to the eardrum. Particularly, in the positioned hearing system of EP2015-187326, the anchor pin penetrates the skin layer in the ear canal to be implanted in the bone. Problems such as infection of damaged skin layer due to inflow of water or foreign substances from the outside are serious.

A lot of researches and developments have been done on the technology of installing the hearing aid on the eardrum. From an implantable and external hearing systems having a floating mass transducer of U.S. Ser. No. 09/175,199 and a contact transducer assembly for a hearing device of KR1993-0701355 to a transducer devices and methods for hearing of U.S. Ser. No. 15/944,595, research and development have been done on the technology of directly attaching the vibration device to the eardrum. In the above-described technologies, the hearing aid is attached to an outer surface of the eardrum. However, an eardrum vibration device for an implantable hearing aid and an installation device for the eardrum vibration device of KR2008-0066061 related to an eardrum penetration device causing a damage in some regions of the eardrum, and an eardrum penetration vibration element and an implantable hearing aid using the vibration element of KR2008-0002461 are introduced. However, a thickness of the eardrum is very thin, about 0.1 mm and a length and a width thereof are 9 mm, respectively. Accordingly, the eardrum is very small, and it is difficult to install the vibration device on the eardrum. Moreover, it is difficult to maintain the fixing of the vibration device to the eardrum for a long time, most regions of the eardrum are covered with the vibration device, and there is a problem that the residual auditory acuity of the eardrum cannot be used. In addition, if a pressure is continuously applied to the auditory ossicle being in contact with the eardrum, a serious problem such as a bone melting phenomenon occurs.

DISCLOSURE

Technical Problem

An embodiment of the present disclosure provides a sound anchor capable of solving problems of the related art, being installed in a human body through a simple surgery capable of minimizing a limitation of a medical law, and transmitting a high quality sound, and a hearing aid having the sound anchor.

Furthermore, an embodiment of the present disclosure provides a sound anchor which can be linked with various hearing aids such as an earring type hearing aid and an ear canal type hearing aid without any limitations on the way of wearing.

Furthermore, in order to solve a problem that the bone conduction hearing aid inserted to the ear canal actually stimulates the cartilage and the quality of the sound transmission decreases in the related art, an embodiment of the present disclosure provides a sound anchor capable of directly transmitting a sound to a bone in the ear canal or indirectly transmitting the sound through a thin skin layer, or transmitting the sound to an eardrum and an auditory ossicle, and a hearing aid having the sound anchor.

Furthermore, an embodiment of the present disclosure provides a sound anchor which does not include a separate battery for driving the sound anchor so as to solve a problem caused by a periodic replacement of the battery, and a hearing aid having the sound anchor.

Furthermore, an embodiment of the present disclosure provides a sound anchor capable of solving problems of infection and cleanliness of the implantable hearing aid with skin damages in the related art, and a hearing aid having the sound anchor.

Furthermore, an embodiment of the present disclosure provides two types of sound anchor, that is, a basic sound anchor connected to an external sound element and a sound anchor in which a micro sound element is built.

Technical Solution

According to an aspect, there is provided a sound anchor for transmitting a sound and vibration to human tissues in an ear canal. The sound anchor includes: a first link; and an anchor which is fixed to an ear canal inner wall of a user, receives the sound and vibration from the first link, and transmits the sound and vibration to at least one of an ear canal bone portion, a bone portion skin surface, and an auditory ossicle protrusion portion of an eardrum, in which the anchor includes a bar-shaped connection portion and an ear canal contact portion which is installed in the connection portion, the ear canal contact portion includes a first contact portion which is installed in one end portion of the connection portion and is in contact with the skin surface or the bone portion, and a second contact portion which is installed in the other end portion of the connection portion and is in contact with the skin surface or the bone portion, and the first link is attachable to or detachable from the anchor.

In another aspect, the sound and vibration may be directly transmitted to a bone portion in the ear canal facing the skin surface.

In still another aspect, the connection portion may include a first connection portion in which the first contact portion is installed, a second connection portion in which the second contact portion is installed, and a connection portion length adjustment device which connects the first connection portion and the second connection portion to each other, and the connection portion length adjustment device may provide a restoring force when a length of the connection portion is contracted to fix the anchor to the ear canal.

In still another aspect, the connection portion length adjustment device may include a spring which is attachable to or detachable from the first and second connection portions.

In still another aspect, each of the first and second contact portions may be made of an elastic material, the first contact portion may be located to surround the one end portion of the connection portion in a state where an upper surface of the connection portion is exposed, the second contact portion may be located to surround the other end portion of the connection portion in a state where a lower surface of the connection portion is exposed, and when the anchor is installed in the ear canal inner wall, the first and second contact portions may be transformed according to a shape of the ear canal inner wall so that each of the upper surface and the lower surface of the connection portion comes into contact with the skin surface.

In still another aspect, one end of the first link may be attachable to or detachable from the anchor through magnetic coupling and decoupling.

In still another aspect, the first link may include a 1-1th link and a 1-2nd link which connects the 1-1th link and the anchor to each other, and when the first link is inserted into the ear canal, the 1-2nd link may be flexible to be bent by attraction according to the magnetic coupling.

In still another aspect, a groove portion which accommodates the one end of the first link and is magnetically coupled to the one end of the first link may be formed in the connection portion.

In still another aspect, the first link may be attachable to or detachable from the first connection portion or the second connection portion.

In still another aspect, the sound anchor may further include a second link which receives the sound and vibration from the anchor and transmits the sound and vibration to the eardrum and an auditory ossicle of the user, in which one end of the second link may be in contact with the eardrum, and the other end of the second link may be connected to the anchor.

In still another aspect, the one end of the second link may be in contact with a region, which is protruded by a short process of a malleus of the auditory ossicle, in a surface region of the eardrum.

In still another aspect, a cap which has a shape corresponding to the protrusion region and covers the protrusion region may be installed in the one end of the second link.

In still another aspect, the sound and vibration transmitted from the first link may be transmitted to a skin surface in the ear canal bone portion of the user via the anchor through bone conduction to provide bone conduction auditory acuity, and the sound and vibration transmitted from the anchor may be transmitted to the eardrum and auditory ossicle via the second link to provide auditory acuity generated by a vibration of the auditory ossicle.

In still another aspect, there is provided a sound anchor for transmitting a sound and vibration to human tissues in an ear canal. The sound anchor includes: a first link; and an anchor which is fixed to an ear canal inner wall of a user and connected to the first link, in which the anchor includes a bar-shaped connection portion, an ear canal contact portion which is installed in the connection portion and is in contact with a skin surface of the ear canal, and an output unit which is provided in the connection portion, generates the sound or vibration based on a signal from the first link, and outputs the sound or vibration to a bone portion, and the first link is attachable to or detachable from the anchor.

In still another aspect, there is provided a sound anchor for transmitting a sound and vibration to human tissues in an ear canal. The sound anchor includes: a first link; and an anchor which is fixed to an ear canal inner wall of a user and connected to the first link, in which the anchor includes a bar-shaped connection portion and a micro-needle which is provided on one side and/or the other side of the connection portion, the micro-needle penetrates a skin layer in the ear canal to come into contact with a temporal bone corresponding to the penetrated skin layer, the sound and vibration transmitted from the first link are transmitted to the temporal bone via the connection portion and the micro-needle, and the first link is attachable to or detachable from the anchor.

In still another aspect, there is provided a sound anchor for transmitting a sound and vibration to human tissues in an ear canal. The sound anchor includes: a first link; an anchor which is fixed to an ear canal inner wall of a user and connected to one end of the first link; a second link, one end of which is connected to the anchor, and a cap which is connected to the other end of the second link and located to be close to an eardrum of the user, in which the first link and the second link are connected to each other, a sound generated from an external device connected to the other end of the first link is transmitted to the eardrum and an auditory ossicle via the first and second links and the cap, and the first link is attachable to or detachable from the anchor.

In still another aspect, the first link and the second link may be connected to each other to constitute one tube.

In still another aspect, there is provided a semi-implantable hearing aid including: the sound anchor; and an external device which is connected to the first link and generates a sound and vibration using a sound signal transmitted from the first link.

Advantageous Effects

The present disclosure has an advantage in that a limitation of a medical law can be minimized since surgery such as incision of skin tissues is not required, a problem of a safety in a material constituting a device can be avoided, and infection or cleanness due to damages of skin tissues does not occur.

Specifically, in the present disclosure, an anchor is not installed by incision of the skin, and the anchor is installed by being fixed to an ear canal inner wall. Accordingly, a complicated surgical procedure is not required, and it is possible to prevent side effects such as a disease in the ear canal caused by the skin damage.

Furthermore, a sound stimulation is directly or indirectly transmitted to the bone portion through a thin skin layer in an ear canal bone portion, and the sound stimulation is transmitted through an eardrum of the ear canal and an auditory ossicle. Accordingly, the present disclosure has an advantage in that a distance between a transmission point of the stimulation and a cochlea is short, and, thus, sound efficiency of the sound is improved.

Furthermore, the present disclosure has an advantage in that a structure of a sound anchor is simple, and, thus, a closing sense caused by sealing of the ear canal decreases.

Furthermore, the present disclosure has an advantage in that a free space in the ear canal is sufficiently secured in a state where the sound anchor is mounted, and, thus, it is possible to diagnose or treat the ear canal. Furthermore, the present disclosure has an advantage in that even when the device is required to be removed, such as when a complicated surgery on a human body in an ear or a diagnosis such as Mill is required, the anchor can be easily removed from the inside of the ear canal.

Furthermore, the present disclosure has an advantage in that a shape of a ear canal contact portion is easily transformed according to a shape of the skin layer in the ear canal, and, thus, the anchor is stably fixed to the ear canal regardless of a shape of the ear canal inner wall, and it is possible to prevent a skin pain.

Furthermore, a micro-needle on the anchor penetrates the skin layer in the ear canal to come into contact with the temporal bone, and as a result, the anchor is fixed to the ear canal. Accordingly, the present disclosure has an advantage in that a pressure applied to the skin layer by the anchor is minimized, a pain does not occur, only the micro-needle having a very thin thickness penetrates the skin layer, and, thus, infection of the skin layer can be prevented.

Furthermore, the present disclosure has an advantage in that a pressure applied to the eardrum is maintained to be equal to less than a predetermined reference value so that damages of the eardrum are prevented, and a pressure applied to the auditory ossicle is maintained so that bone melting of the auditor ossicle is prevented.

Furthermore, the present disclosure has an advantage in that a vibration generated from an external device separable from the sound anchor is transmitted to the sound anchor, the sound anchor needs not include an electronic device or a battery, and, thus, it is not necessary to consider a periodic replacement of the battery.

Furthermore, the present disclosure has an advantage in that the structure of the sound anchor is made simple, it is possible to minimize an impact on a human body.

Furthermore, the present disclosure has an advantage in that stimulation is applied to an auditory ossicle of a serious hearing loss patient of which the auditory ossicle is maintained but the auditory ossicle is very bad through an eardrum so that the sound is transmitted.

Furthermore, the present disclosure has an advantage in that it is possible to improve a transmission quality of a sound using an amplification function of the sound through a plurality of auditory ossicles from a short process of a malleus.

Furthermore, the present disclosure has an advantage in that a vibration can be intensively transmitted to the short process of the malleus without damaging a remaining auditory acuity. Furthermore, the present disclosure has an advantage in that a sound can be transmitted to the short process of malleus of the auditory ossicle protruding through the eardrum, similarly to an anatomical physiological vibration method, and, thus, the sound transmission is ergonomically simple and efficient.

Furthermore, the present disclosure has an advantage in that a hybrid sound transmission is possible, in which a sound transmission through the bone conduction and a sound transmission through vibrations of the eardrum and auditory ossicle are used together.

MODE FOR INVENTION

Figure 1A:
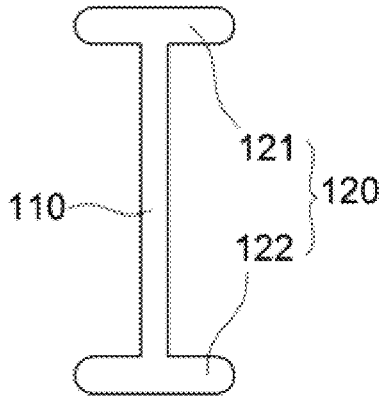
FIGS. 1A, 1B, 1C, 1D and 1E are diagrams schematically showing a structure of a sound anchor for transmitting a vibration to a skin layer in an ear canal according to a first embodiment of the present disclosure.

Various modifications can be applied to the present disclosure, and the present disclosure may have various embodiments. Accordingly, specific embodiments are shown in the drawings and described in detail. Effects and characteristics of the present disclosure, and a method for achieving the present disclosure will be described with reference to the drawings and will be apparent with reference to the embodiment. However, the present disclosure is not limited to the embodiments described later and various forms of the present disclosure may be implemented. In the following embodiment, terms such as first, second, or the like are used for the purpose of distinguishing one component from other components rather than a restrictive meaning. Moreover, singular expressions include plural expressions unless the context clearly indicates otherwise. In addition, terms "including" and "having" mean that features or components described in the specification are present, and do not preclude the possibility of adding one or more other features or components. In addition, in the drawings, components may be exaggerated or reduced in size for convenience of description. For example, since a size and a thickness of each component shown in the drawings are arbitrarily shown for convenience of description, the present disclosure is not necessarily limited to the drawings.

Hereinafter, embodiments of the present disclosure are described in detail with reference to the accompanying drawings, the same reference numerals are assigned to the same or corresponding components when the embodiments are described with reference to the drawings, and repeated descriptions thereof are omitted.

Method of Transmitting Stimulation to Bone Portion through Vibration Transmission to Skin Layer in Ear Canal FIGS. 1A to 1E are diagrams schematically showing a structure of a sound anchor for transmitting a vibration to a skin layer in an ear canal according to a first embodiment of the present disclosure. In addition, FIGS. 2A to 2E are conceptual diagrams showing how the sound anchor of the first embodiment shown in FIGS. 1A to 1E is installed in the ear canal.

With reference to FIGS. 1A to 2E, a sound anchor 10 according to the first embodiment includes an anchor 100.

The anchor 100 is installed in an ear canal 1. Specifically, the anchor 100 may be installed in the ear canal 1 across a circumference inside the ear canal 1. In addition, the anchor 100 is installed in a skin region nearest a temporal bone in the ear canal 1. That is, when the anchor 100 is installed in the ear canal 1, a very thin skin layer is located between the anchor 100 and the temporal bone, and a distance between the anchor 100 and the temporal bone is very short.

The anchor 100 may include a connection portion 110 and an ear canal contact portion 120. Moreover, the ear canal contact portion 120 may include a first contact portion 121 and a second contact portion 122.

Figure 2A:
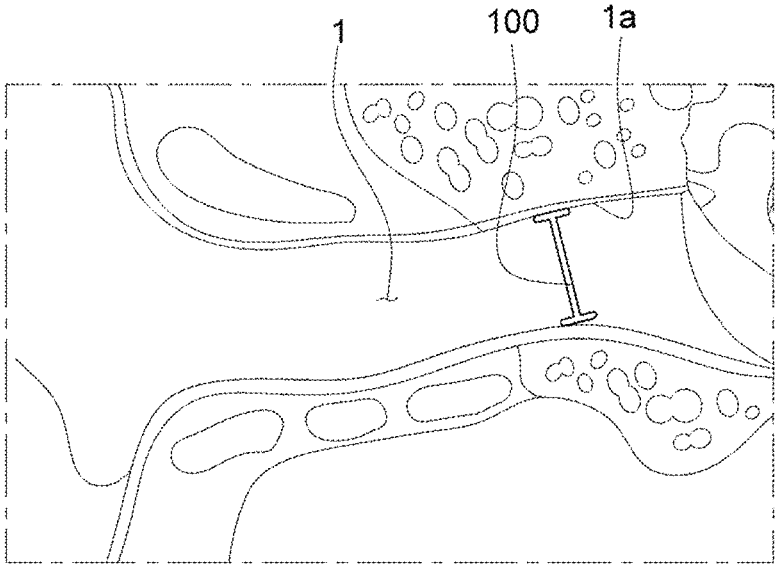
FIGS. 2A, 2B, 2C, 2D and 2E are conceptual diagrams showing the first embodiment shown in FIGS. 1A to 1E being installed in the ear canal.
Figure 2B:
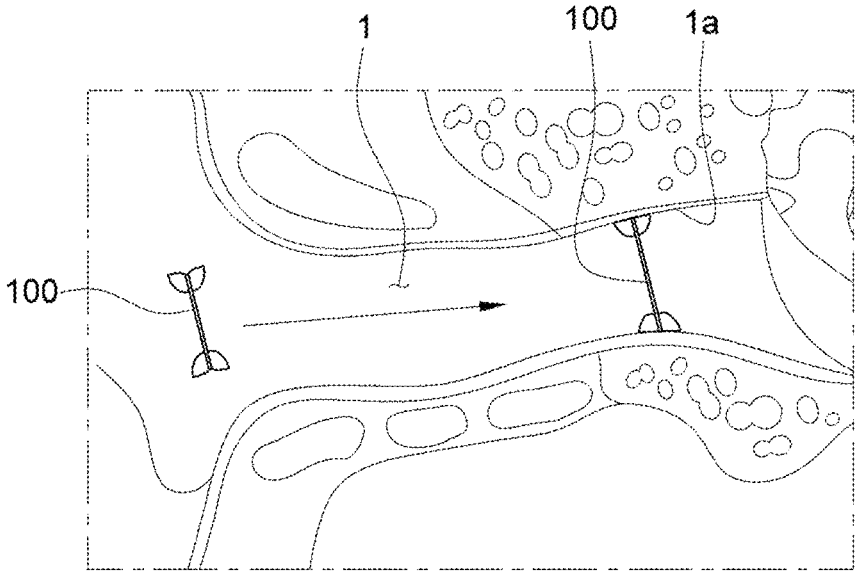

For example, FIGS. 1A and FIG. 2A, the connection portion 110 and the ear canal contact portion 120 may be integrally formed with each other and installed in the ear canal 1.

The connection portion 110 and the ear canal contact portion 120 may have a capital letter "I" as a whole.

The connection portion 110 may have a vertical bar shape and have a length corresponding to a diameter in the ear canal 1 of a user. That is, the connection portion 110 may have a length corresponding to the diameter of the ear canal at a point where the connection portion 110 is installed in the ear canal 1 of the user.

The first contact portion 121 may be formed on one end of the connection portion 110, and the second contact portion 122 may be formed on the other end of the connection portion 110.

The overall shape of each of the first and second contact portions 121 and 122 may be a bar shape perpendicular to the connection portion 110 as illustrated, but the present disclosure is not limited thereto. The overall shape of each of the second contact portions 121 and 122 may be changed. In addition, a contact surface between each of the first and second contact portions 121 and 122 and a skin surface 1*a* in the ear canal may have a shape corresponding to the skin surface 1*a* in the ear canal 1 of the user which is in contact with the first and second contact portions 121 and 122. Specifically, the shape of the contact surface of each of the first and second contact portions 121 and 122 may be determined such that the contact surfaces of the first and second contact portions 121 and 122 which are in contact with the skin surface 1*a* in the ear canal 1 are maximized.

Meanwhile, preferably, a size of the contact surface of each of the first and second contact portions to the skin surface 1*a* in an ear canal 1 is determined by the factors that the contact surface should be designed in consideration of the shape of the ear canal as the size of the contact surface increases and that a possibility of making the user feel a pain increases when the ear canal contact portion 120 and the skin surface 1*a* in the ear canal 1 comes into contact with each other as the size of the contact surface decreases.

The anchor 100 may be made of a titanium, but the present disclosure is not limited thereto. The anchor 100 may be made of a material having an appropriate strength without being discolored, damaged, or deformed due to various foreign matters such as moisture, earwax, or the like flowing in from the outside. Here, the appropriate strength means a strength enough to be fixed to the ear canal inner wall so that the anchor 100 is not damaged or is not released and detached from the fixing in the ear canal 1 even in a daily life or an exercise situation of the user.

In another aspect, some regions of the connection portion 110 may constitute a portion of the ear canal contact portion. For example, referring FIG. 1B and FIG. 2B, the connection portion 110 may have a bar shape as a whole, and upper and lower surfaces of both end portions may come into contact with the skin surface in the ear canal 1. More specifically, the upper and lower surfaces of both end portions can come into contact with the skin surface 1*a*. In addition, the ear canal contact portion 120 may be configured to surround the end portion of the connection portion 110. Specifically, the first contact portion 121 may be configured to surround one end portion of the connection portion 110 while exposing an upper surface of the one end portion of the connection portion 110, and the second contact portion 122 may be configured to surround the other end portion of the connection portion 110 while exposing an upper surface of the other end portion of the connection portion 110.

The ear canal contact portion 120 may be made of an elastic material. For example, the ear canal contact portion 120 may be made of a silicon, and the connection portion 110 may be formed of a titanium. However, the material of each of the ear canal contact portion 120 and the connection portion 110 is not limited to the above-described materials. That is, each of the ear canal contact portion 120 and the connection portion 110 may be made of a material having a large natural deformation resistance and an appropriate strength without being discolored, damaged, or deformed due to various foreign matters such as moisture, earwax, or the like flowing in from the outside. Moreover, the ear canal contact portion 120 may be made of a material having an appropriate elasticity in consideration of preventing a pain caused by the contact with the skin surface 1*a* in the ear canal 1 and maintaining a fixing force.

An upper surface of the first contact portion 121 may be configured so as to protrude from the upper surface of one end portion of the connection portion 110, and an upper surface of the second contact portion 122 may be configured so as to protrude from the upper surface of the other end portion of the connection portion 11. That is, when the anchor 100 is installed in the ear canal, a degree of the protrusion is determined such that a pressure caused by the contact between the skin surface 1*a* in the ear canal 1 and the anchor 100 is applied to the upper surface of the ear canal contact portion 120, and the upper surfaces of the second contact portions 121 and 122 and the upper surfaces (upper surface of the connection portion and the lower surface of the connection portion) of one end portion and the other end portion of the connection portion 110 can come into simultaneous contact with the skin surface 1*a* in the ear canal 1.

Figure 2C:
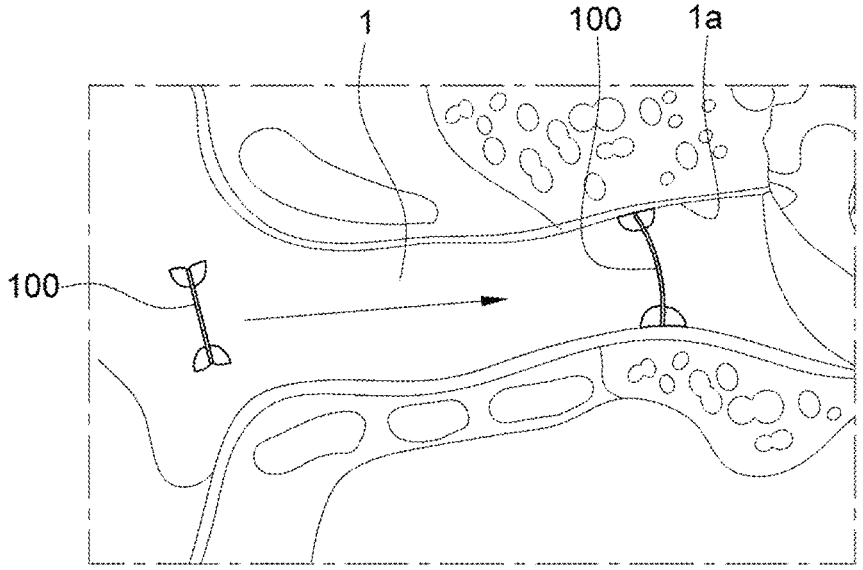

Meanwhile, a predetermined bending may be generated in the connection portion 110 by the pressure applied to both end portions. For example, as shown in FIG. 2C, in a case where a diameter of the ear canal inner wall is shorter than the length of the connection portion 110, when the anchor 100 is installed in the ear canal 1, a predetermined bending is generated in the connection portion 110 by the pressure applied to both end portions. In addition, the anchor 100 may be installed to be fixed to the ear canal inner wall by a force generated when the connection portion 110 bent to a predetermined degree attempts to return to an original shape.

Figure 1B:
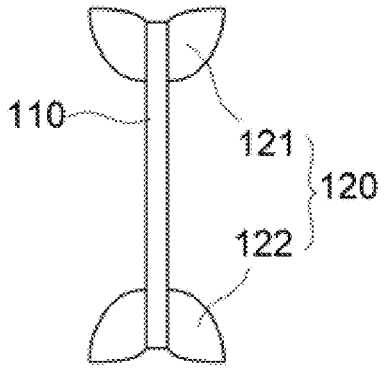
Figure 1C:
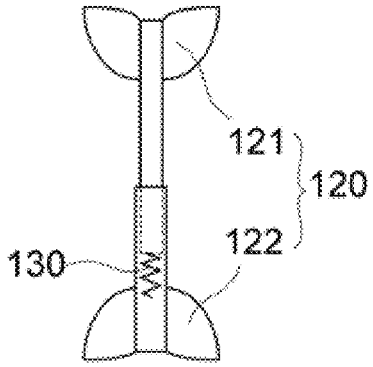
Figure 2D:
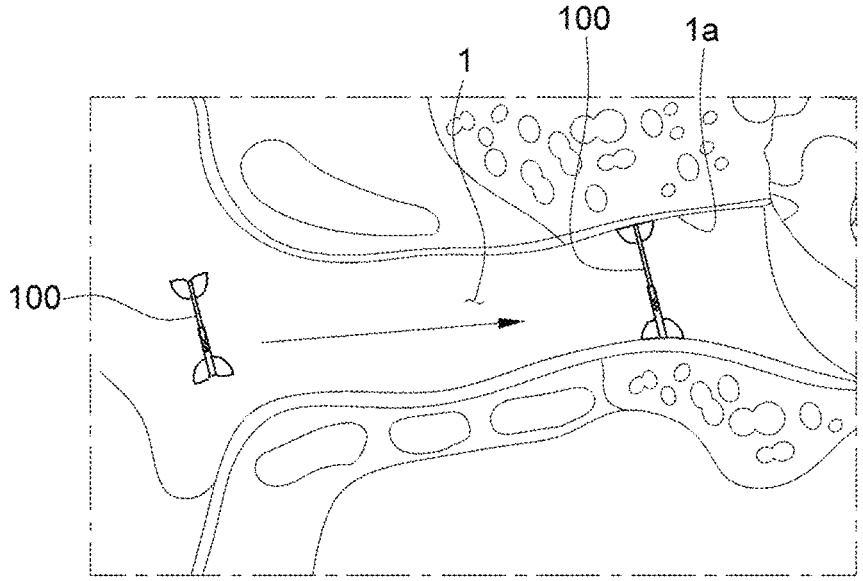

In still another aspect, the anchor 10 according to the first embodiment may further include a connection portion length adjustment device 130. For example, referring to FIG. 1C, the connection portion 110 may include a first connection portion 111 and a second connection portion 112. Moreover, the first contact portion 121 may be provided on one side of the first connection portion 111, and the other side of the first connection portion 111 may be inserted into a portion of the second contact portion 112. Moreover, the second contact portion 122 may be provided on the other side of the second connection portion 112. In addition, for example, a small spring corresponding to the connection portion length adjustment device 130 may be installed inside the side of the second connection portion 112. Moreover, for example, as shown in FIG. 2D, when the anchor 100 is installed in the ear canal, a pressure is applied to both end portions of the connection portion 110. In addition, the small spring is contracted by this pressure, and an insertion length of the other end portion of the first connection portion 111 into the one side of the second connection portion 112 increases. Therefore, the overall length of the connection portion 110 can be converted into a length corresponding to the diameter of the ear canal inner wall. In addition, the anchor 100 may be stably fixed to the ear canal inner wall by a restoring force of the small spring.

Figure 1D:
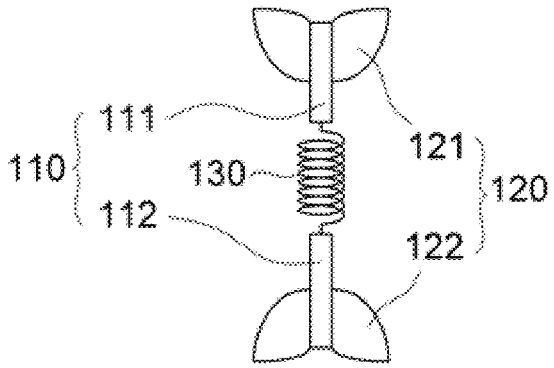

According to some embodiments, as shown in FIG. 1D, the first and second connection portions 111 and 112 may be connected to each other through a connection portion length adjustment device 130.

The connection portion length adjustment device 130 may be a compression spring or a leaf spring, but the present disclosure is not limited thereto.

Specifically, a first contact portion 121 may be installed on one side of the first connection portion 111, and the other side of the first connection portion 111 may be connected to the connection portion length adjustment device 130. Moreover, one side of the second connection portion 112 may be connected to the connection portion length adjustment device 130, and a second contact portion 122 may be installed on the other side of the second connection portion 112.

Figure 2E:
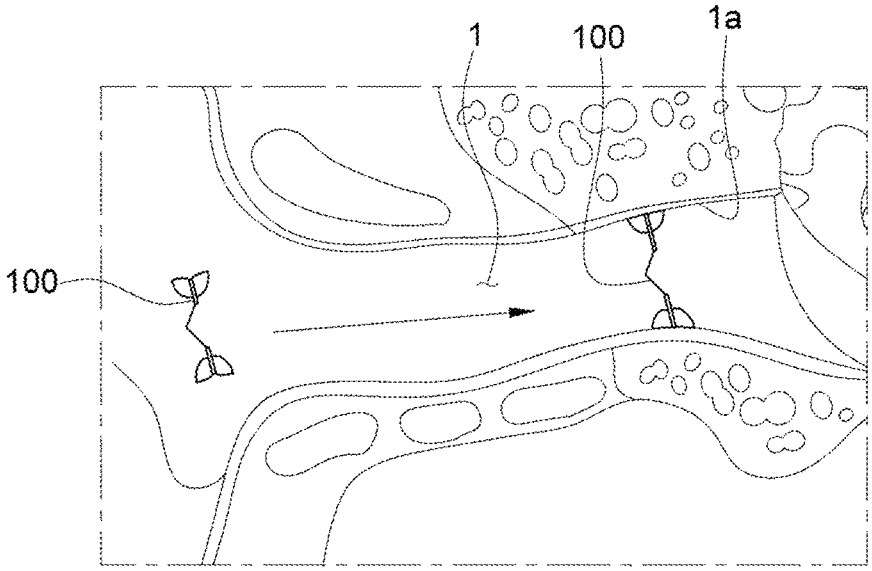

Referring to FIG. 2E, a connection portion length adjustment device 130 is contracted by a pressure applied to both end portions of the connection portion 110, and the anchor 100 is installed to be fixed in the ear canal 1 by a restoring force caused by an elastic force of the connection portion length adjustment device 130.

Meanwhile, the connection portion length adjustment device 130 may be configured to be attachable to or detachable from the connection portion 110. Therefore, when a fixing force of the anchor 100 in the ear canal 1 is weakened due to weakening of the elastic force of the connection portion length adjustment device 130 over time, the connection portion length adjustment device 130 may be replaced. In addition, various connection portion length adjustment devices 130 having an appropriate length and an appropriate elasticity may be applied to the anchor 100 in consideration of the diameter of the ear canal inner wall for each user and an intensity of the pain felt by the user.

In each of the embodiments according to FIGS. 1C and 1D, the connection portion length adjustment device 130 is further applied to the anchor 100, and, thus, it is possible to adjust the overall length of the connection portion 110 according to the circumference of the ear canal. In addition, the spring described as the exemplary configuration of the connection portion length adjustment device 130 can be replaced, and, thus, it is possible to manufacture the customized anchor 100. In addition, in the embodiment according to FIG. 1D, since the structures of the connection portion 110 and the connection portion length adjustment device 130 are very simple, there are advantages that the manufacturing of the anchor 100 is easy and a cost is reduced.

In the embodiments shown in FIGS. 1A to 1E, the anchor 100 is installed to be fixed to the ear canal inner wall without using an implantation method accompanying with a skin incision method. Accordingly, a complicated surgical procedure is not required, and it is possible to prevent side effects such as a disease in the ear canal caused by a skin damage.

Moreover, the anchor 100 is installed on an ear canal bone portion or a skin surface of the bone portion to receive a sound and vibration from a first link 200, and, thus, is installed in a skin region closest to the temporal bone. Accordingly, the sound and vibration of the anchor 100 is transmitted to the temporal bone through the skin surface. The sound and vibration are directly transmitted to the bone portion in the ear canal through a thin skin layer, and, thus, a transmission efficiency of the sound according to the bone conduction is very high.

In addition, the ear canal contact portion 120 in the embodiments shown in FIGS. 1B, 1C, and 1D is made of an elastic material. Accordingly, the shape of the ear canal contact portion 120 is easily transformed according to the pressure applied to the ear canal contact portion 120. Accordingly, the shape of the ear canal contact portion 120 is easily transformed according to the shape of the skin layer in the ear canal, and, thus, the anchor 100 is stably fixed to the ear canal regardless of the shape of the ear canal inner wall, and it is possible to prevent a skin pain.

Moreover, when the device is required to be removed, such as when a complicated surgery on a human body in an ear or a diagnosis such as MRI is required, the anchor 100 can be easily removed from the inside of the ear canal.

FIGS. 3A to 3D are diagrams showing a connection relationship between the first link and the anchor of the sound anchor according to the first embodiment of the present disclosure.

Referring to FIGS. 3A to 3D, the sound anchor 10 according to the first embodiment of the present disclosure may further include the first link 200.

However, it should be noted that the first link 200 may be a component included in an external device (not shown) instead of the sound anchor 10. For convenience of description, the first link 200 is a component included in the sound anchor 10.

The first link 200 is a link that transmits a physical vibration transmitted from the external device to the anchor 100. For example, the first link 200 may be formed of a thin metal.

The first link 200 is configured to be attached to or detachable from the anchor 100.

Figure 3A:
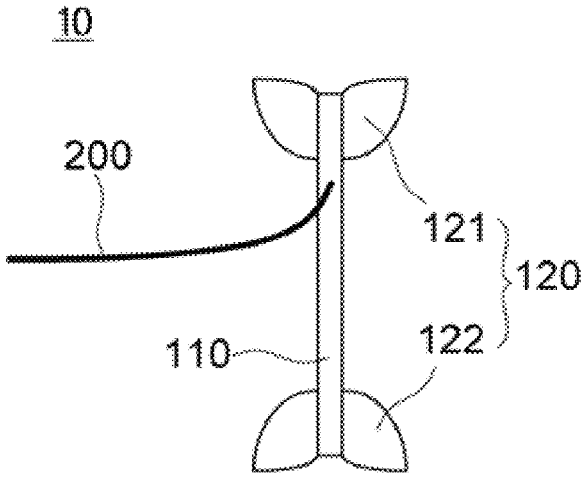
FIGS. 3A, 3B, 3C and 3D are diagrams showing a connection relationship between a first link and an anchor of the sound anchor according to the first embodiment of the present disclosure.
Figure 3B:
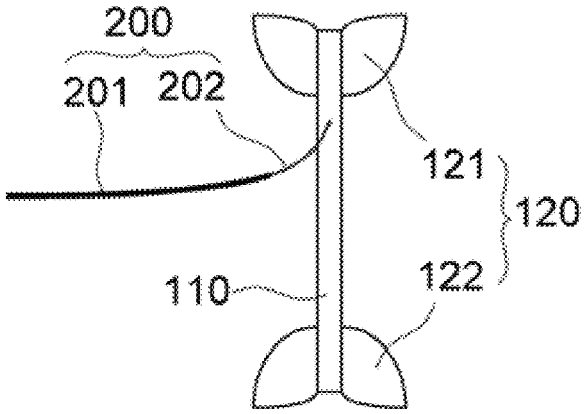
Figure 3C:
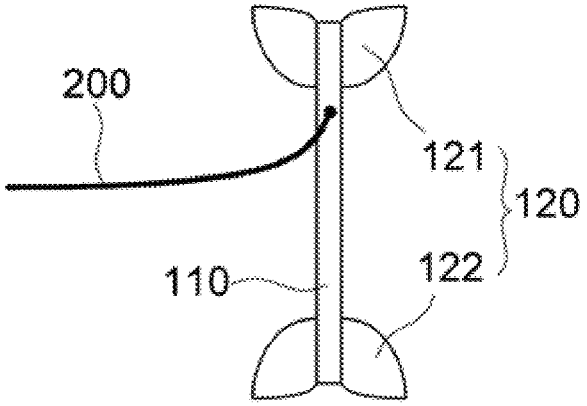

For example, referring to FIG. 3A, the first link 200 may be attached to or detachable from the anchor 100 through magnetic coupling. For example, when an end of the first link 200 approaches the anchor 100, the end of the first link 200 may be attached to the anchor 100 by a magnetic attraction therebetween. In addition, when a force for extracting the first link 200 from the ear canal is applied to the first link 200, the magnetic coupling between the end of the first link 200 and the anchor 100 is released, and, thus, the first link 200 may be detached from anchor 100.

As shown in the drawings, the end of the first link 200 may be attached to or detached from an upper region of the connection portion 110. Unlike shown, the end of the first link 200 may be attached to or detached from a lower region of the connection portion 110.

The end of the first link 200 is attached to the connection portion 110, and a vibration from the first link 200 causes a vibration of the connection portion 110. In addition, the vibration of the connection portion 110 vibrates the skin surface in the ear canal. Moreover, this vibration is transmitted to the temporal bone which is a bone facing the skin surface and allows the bone conduction hearing. In addition, the end of the first link 200 is attached to the upper region or the lower region of the connection portion 110 to transmit the vibration. Therefore, a vibration transmission path from a contact point of the first link 200 and the connection portion 110 to the bone is minimized, and, thus, the vibration can be effectively transmitted.

In another aspect, the first link 200 may be divided into a 1-1th link and a 1-2nd link. For example, referring to FIG. 3B, the first link 200 may include the 1-1th link 201 extracted from a sound element which is the external device, and the 1-2nd link 202 which extends from the 1-1th link 201. The 1-1th link 201 may have a first strength and the 1-2nd link 202 may have a second strength. Moreover, the second strength may be weaker than the first strength. For example, the 1-1th link 201 may have a rigidity which is not bent unless a strong physical force is applied to the 1-1th link 201, but the 1-2nd link 202 may have a rigidity to the extent that it is bent even if a small force is applied to the 1-2nd link. In some embodiment, the 1-2nd link 202 may have a flexible structure.

When the first link 200 approaches the connection portion 110, the 1-2nd link 202 of the first link 200 may be bent and magnetically coupled to the connection portion 110. In addition, the degree of bending of the 1-2nd link 202 may be changed depending on the proximity between the first link 200 and the connection portion 110. Assume a situation where the first link 200 separated from the connection portion 110 through the flexible structure of the 1-2nd link 202 is inserted into the ear canal and attached to the connection portion 110. In this case, even if the end of the first link 200 does not correctly approach a magnetic coupling point of the connection portion 110, the end of the 1-2nd link 202 is bent and naturally attached to the magnetic coupling point of the connection portion 110.

In still another aspect, the first link 200 may be configured to have an increased size at the end. For example, referring to FIGS. 3C, the end of the first link 200 may have a size larger than those of other regions. Accordingly, a magnetic coupling area with the connection portion 110 can increase, and, thus, the first link 200 can be more easily coupled to the connection portion 110.

Although not shown in the drawings, as described above, the anchor 100 may further include the connection portion length adjustment device 130, and the end of the first link 200 may be attached to or detached from any one of the first and second connection portions 110 and 112.

In still another aspect, the connection portion 120 may include a groove portion to facilitate the magnetic coupling with the first link 200.

Figure 3D:
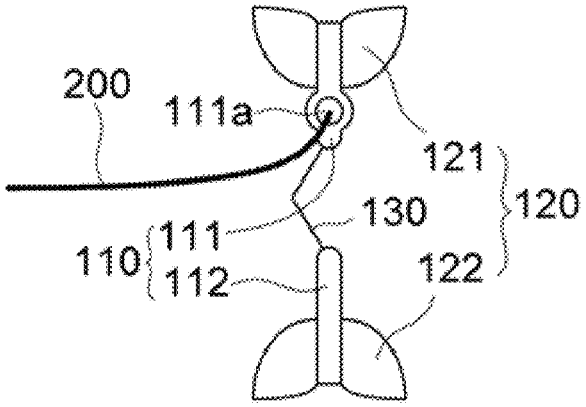

Specifically, referring to FIG. 3D, the anchor 100 may include the first connection portion 111, the first contact portion 121 which is installed in the first connection portion 111, the second connection portion 112, the second contact portion 122 which is installed in the second connection portion 112, and the connection portion length adjustment device 130 which is provided between the first and second connection portions 111 and 112. In addition, a groove portion 111*a* may be formed in the first connection portion 111. Unlike the drawing, the groove portion may be formed in the second connection portion 112.

The end of the first link 200 is accommodated in the groove 111*a* of the first connection portion 111. Accordingly, attachment and detachment between the first link 200 and the first connection portion 111 is facilitated, a contact area between the first link 200 and the first connection portion 111 increases, and, thus, a vibration transmission efficiency increases.

Moreover, in some embodiments, a hole other than the groove portion 111*a* may be formed in the first connection portion 111. In this case, the end of the first link 200 is inserted into the hole, and a peripheral region of the first link 200 may be attached to the first connection portion 111 by a magnetic attraction.

Since the sound anchor 10 according to the first embodiment of the present disclosure is installed in the ear canal through a non-surgical method, it is possible to greatly shorten an installation time of the device.

In addition, since the structure of the anchor 100 is made simple, it is possible to minimize an impact on a human body.

In addition, the anchor 100 is fixed, and the first link 200 for transmitting vibration to the anchor 100 is easily attached to or detached from the anchor 100. Moreover, there is no closing effect, and, thus, it is possible to prevent a user's discomfort caused by a closing sense.

In addition, the anchor 100 is fixed to the ear canal 1 through a simple surgery, it is possible to easily interconnect the devices through the attachment and detachment of the anchor 100, and, thus, the manufacturing of the device and the installation of the device are simple. In addition, the vibration can be directly transmitted to the skin surface in the ear canal bone portion and the bone, and, thus, a sound transmission efficiency is improved. That is, the vibration from the first link 200 is transmitted to the bone through the thin skin layer in the ear canal 1 via the anchor 100, and, thus, the bone can be effectively stimulated. Moreover, a stimulation point of the bone is located at a distance which is short from the cochlea, and, thus, it is possible to a high transmission quality of the sound.

Moreover, if the first link 200 is detached from the anchor 100, only the anchor 100 having a bar shape remains in the ear canal, and, thus, a free space of the ear canal can be maximized. Accordingly, it is possible to diagnose and treat the ear canal even in a state where the anchor 100 exists in the ear canal.

Method of Directly Transmitting Vibration to Eardrum

Figure 4A:
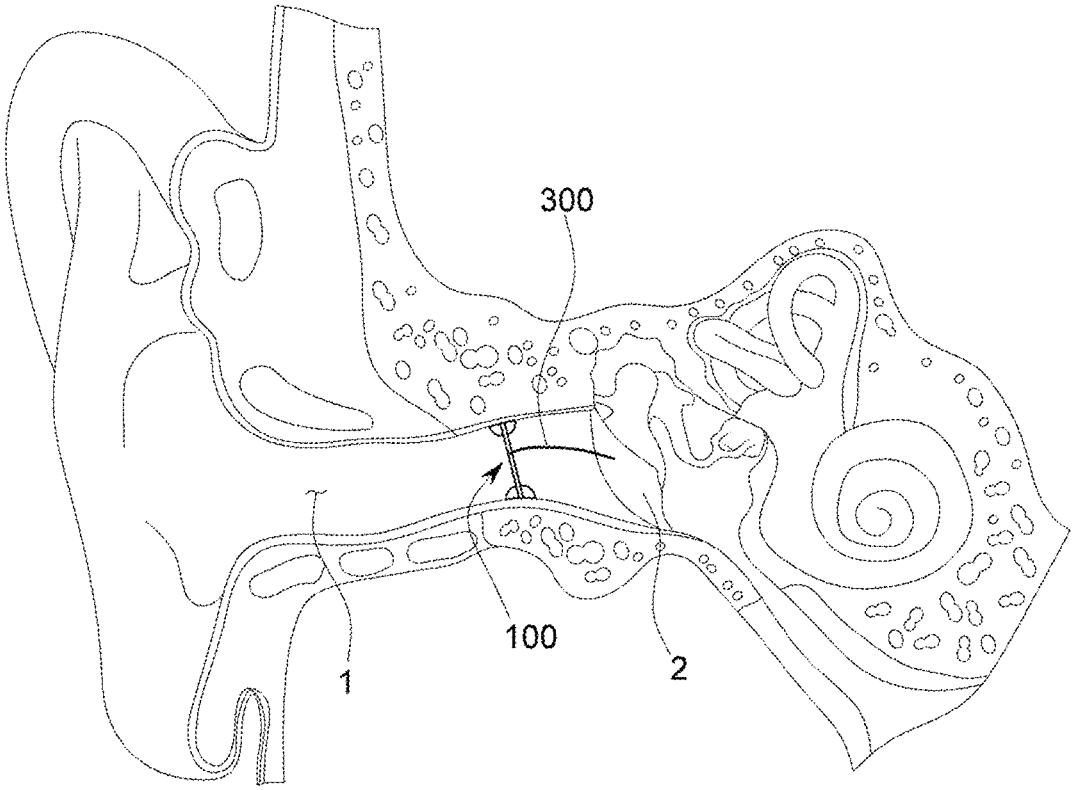
FIG. 4A is a diagram schematically showing a sound anchor according to a second embodiment installed in the ear canal of the present disclosure.
Figure 4B:
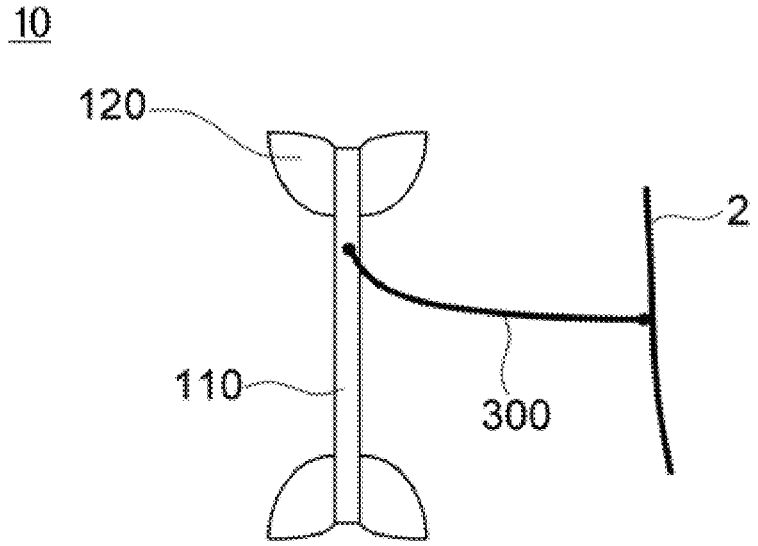
FIGS. 4B*a* and 4B*b* are diagrams schematically showing various forms according to the second embodiment.
Figure 4B:
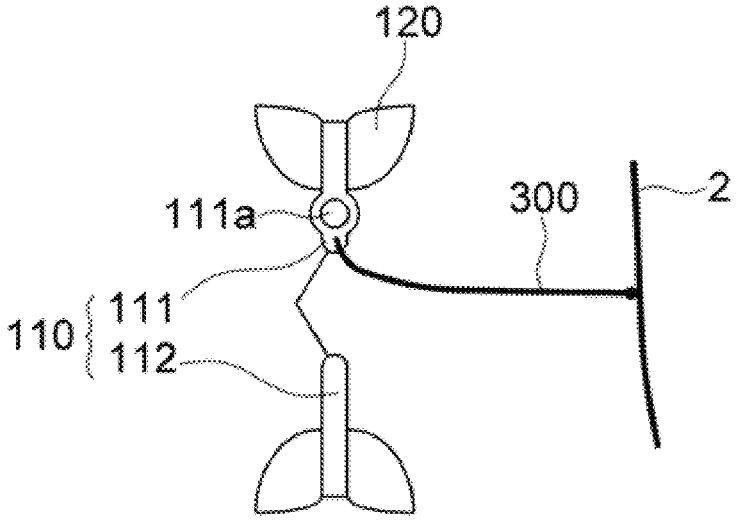
Figure 5:
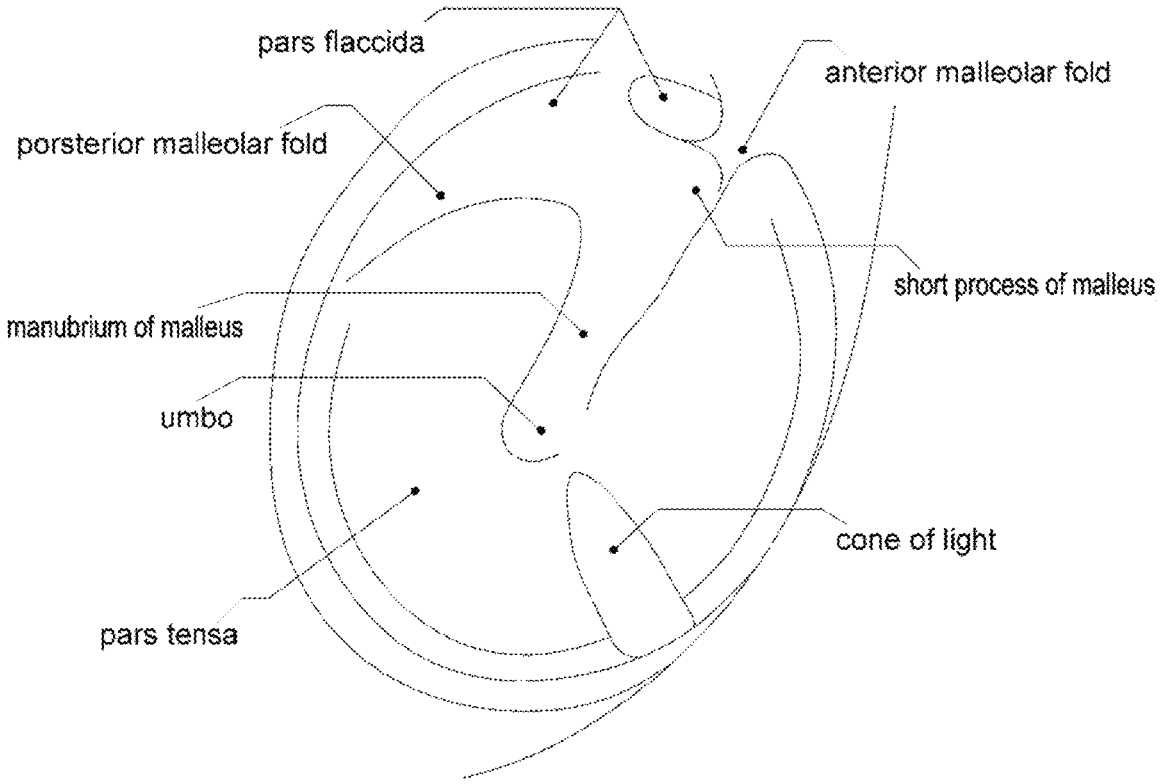
FIG. 5 is a schematic view showing a surface of an eardrum, and shows a protrusion portion of the surface of the eardrum generated by an auditory ossicle.
Figure 6:
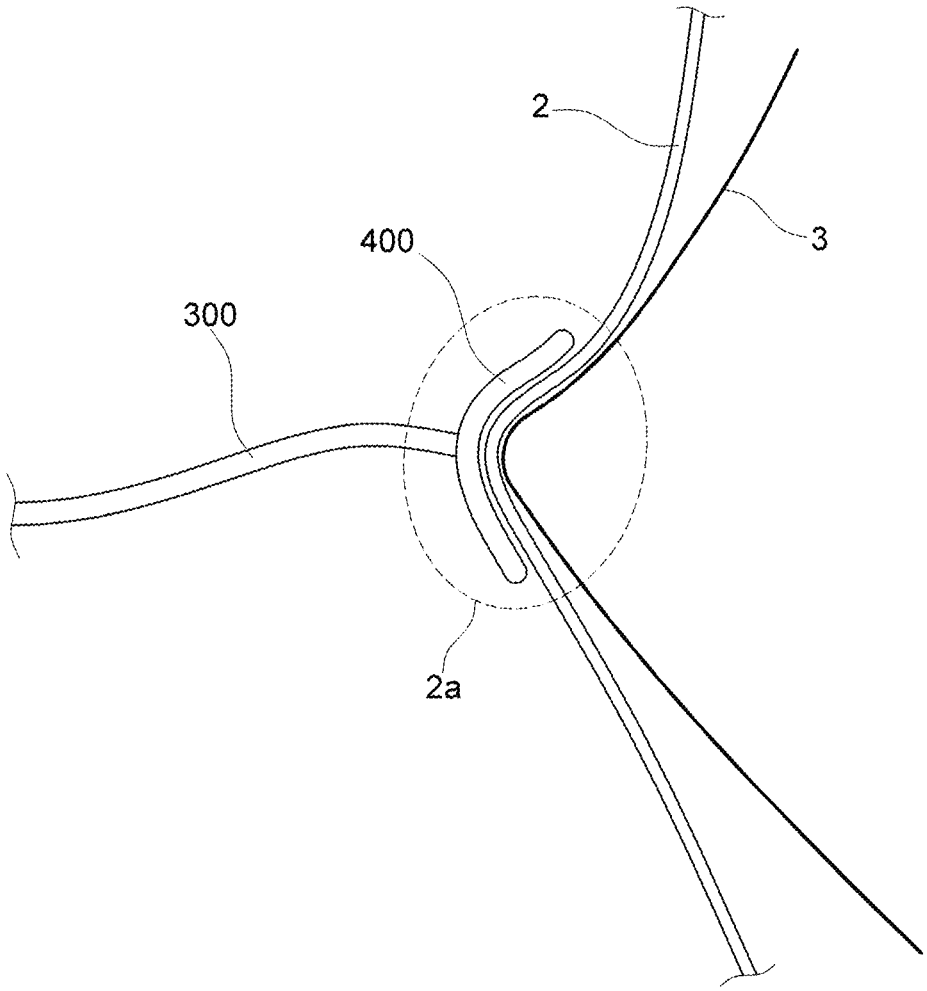
FIG. 6 is a diagram for explaining a cap being located in a protrusion region of the eardrum.

FIG. 4A is a diagram schematically showing a sound anchor according to a second embodiment installed in the ear canal of the present disclosure. FIGS. 4B*a* and 4B*b* are diagrams schematically showing various forms of the sound anchor according to the second embodiment. In addition, FIG. 5 is a schematic view showing a surface of the eardrum, and shows a protrusion portion of the surface of the eardrum generated by an auditory ossicle. Moreover, FIG. 6 is a diagram for explaining a cap being located in a protrusion region of the eardrum.

Referring to FIGS. 4A, 4B*a*, and 4B*b*, a sound anchor 10 according to the second disclosure may include an anchor 100 and a second link 300. The anchor 100 is described above in the first embodiment, and, thus, detailed descriptions of functions and effects of the anchor 100 are omitted.

One end of the second link 300 may be in contact with an eardrum 2, and the other end of the second link 300 may be connected to a connection portion 110.

The second link 300 may be integrally formed with the connection portion 110.

The one end of the second link 300 may be in contact with the eardrum 2 in a state in which a predetermined pressure is applied to the contact area between the one end and the eardrum 2.

Referring to FIG. 5, some regions of the surface of the eardrum 2 may be protruded by the auditory ossicle located at a rear surface of the eardrum 2. The eardrum is a thin membrane having a thickness of about 0.1 mm and has a pearly greyish white color or a light pinkish greyish white color. In addition, a shape of the eardrum 2 is oval, and a central portion thereof is recessed inward to have a trumpet shape. The auditory ossicle is located inside the eardrum (2) and includes a hammer-shape malleus, an anvil-shaped incus, and a stirrup-like stapes. In addition, the malleus, the incus, and the stapes are connected to each other by joints, and the stapes is attached to an oval window by an annular ligament. The malleus is the largest of the auditory ossicle and a length thereof is 7 to 8 mm. Moreover, the malleus consists of a head, a neck, and a handle, and includes an anterior protrusion (long process) and a lateral protrusion (short process). The head of the malleus is located at an upper portion of a tympanic cavity, includes a body of the incus and an incudomalleolar joint. The handle of the malleus is buried in a fibrous layer of the eardrum.

An area which is most recessed inward from a center of the eardrum 2 is referred to as an umbo, which corresponds to an end of the handle of the malleus of the auditory ossicle attached to the inside of the eardrum 2.

Moreover, some regions of an upper portion of the eardrum 2 is protruded by the short process of the malleus.

The one end of the second link 300 is in contact with a protrusion region corresponding to the short process of the malleus in the region of the eardrum 2. The vibration transmitted from the connection portion 110 stimulates the protrusion region through the second link 300. The vibration stimulates the surface of the eardrum 2, and, as a result, the vibration is transmitted to the short process of the malleus located on the rear surface of the eardrum 2. Moreover, the vibration transmitted to the short process of the malleus is amplified via the malleus, the incus, and the stapes.

According to some embodiments, a cap is installed in the one end of the second link 300. For example, referring to FIG. 6, a cap 400 may be installed in the one end of the second link 300, and the cap surrounds a protrusion region 2*a*, which is protruded by a short process 3 of the malleus. The second link 300 and the cap 400 may be integrally formed with each other, the cap 400 may be manufactured to surround the protrusion region 2*a* so as to be connected to one end of the second link 300 and may be installed on the second link 300.

The cap 400 surrounds the protrusion region 2*a*, and, thus, the vibration transmitted from the second link 300 may be transmitted to the entire protrusion region 2*a*, enabling to increase the efficiency of the sound transmission.

In addition, the cap 400 is manufactured according to a shape of the protrusion region 2*a* of the eardrum 2 for each user.

The cap 400 is substantially attached to the eardrum 2. However, the cap 400 is not permanently or semi-permanently attached to the eardrum 2 but may be detached from the eardrum 2 as needed. The position of the second link 300 connected to the anchor 100 fixed to the ear canal is maintained, and, thus, a contact between the cap 400 and the protrusion region 2*a* is maintained. In addition, in a state where the vibration is not transmitted to the cap 400, the pressure due to the contact between the cap 400 and the protrusion region 2*a* is equal to or less than a reference value. In some embodiments, a region near the connection point with the cap 400 of the region of the second link 300 may have a predetermined elasticity to provide a pressure equal to or less than a reference value to the protrusion region 2*a*. Here, the reference value means a level of a pressure that can prevent problems such as damages of the eardrum 2 due to a pressure applied to the eardrum 2 being maintained or bone melting of the auditory ossicle due to a pressure applied to the auditory ossicle being maintained.

In the second embodiment of the present disclosure, the cap 400 covers the region protruded by the short process 3 of the malleus in the region of the eardrum 2, the vibration is transmitted to the cap 400, and, thus, the vibration can be transmitted to the auditory ossicle. That is, the stimulation is transmitted to the auditory ossicle via the eardrum 2, and a step-wise amplification of bones constituting the auditory ossicle is fully used. Accordingly, even a sound having a minute vibration can be transmitted, and the second embodiment can be applied to the hearing loss patient.

In addition, the sound can be transmitted to a user of which the auditory acuity remains only partially, and the vibration can be transmitted intensively to the short process 3 of the malleus without damaging a remaining auditory acuity. Moreover, the short process 3 of the malleus is stimulated, and, thus, the sound can be effectively transmitted ergonomically.

Figure 7:
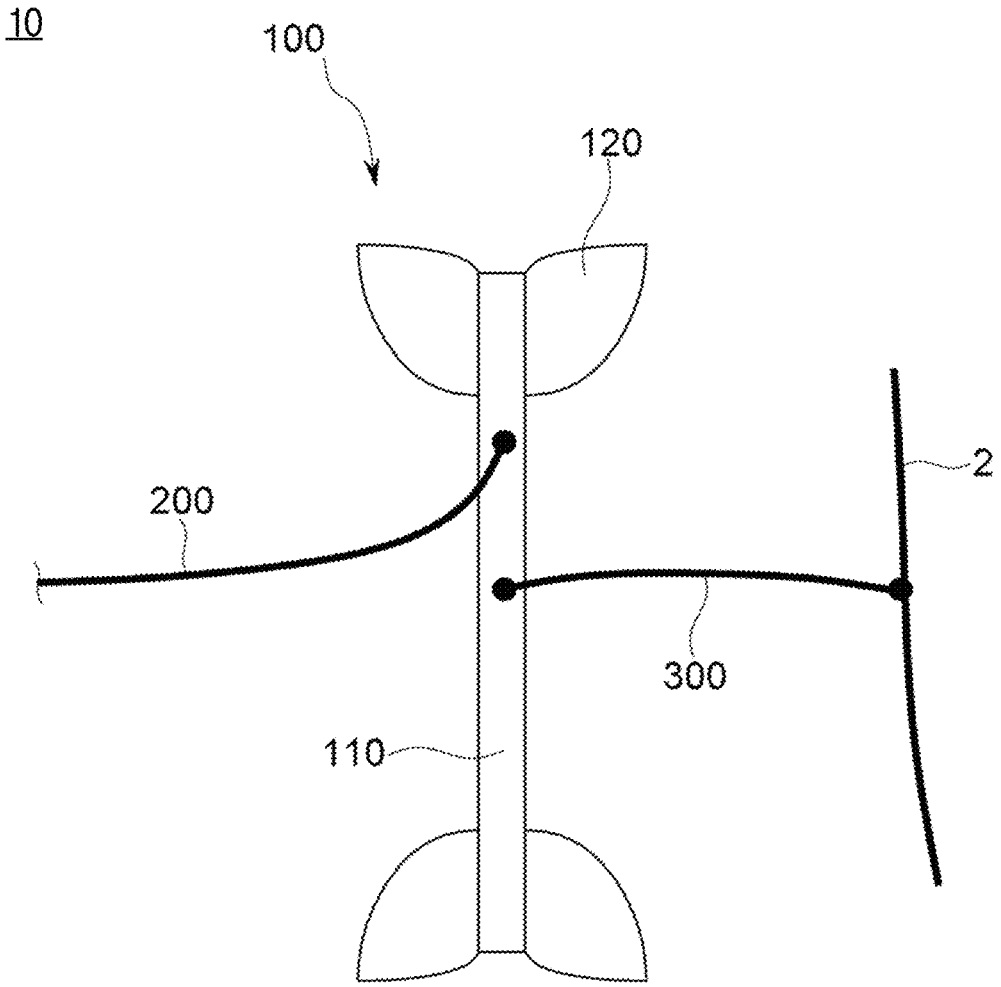
FIG. 7 is a conceptual diagram of a sound anchor including a first link, a second link, and an anchor.

FIG. 7 is a conceptual diagram of a sound anchor including a first link, a second link, and an anchor.

Referring to FIG. 7, each of the first link 200 and the second link 300 may be connected to the anchor 100. Even if the first link 200 and the second link 300 are not directly coupled to each other, the vibration of the first link 200 may be transmitted to the second link 300 through the connection portion 110. The first link 200 may be configured to be attached to or detachable from the anchor 100, and the second link 300 may be fixed to the anchor 100. Therefore, even when the first link 200 is detached, the anchor 100 and the second link 300 may be maintained in the ear canal of the user.

In addition, a contact point between the first link 200 and the anchor 100 and a contact point between the second link 300 and the anchor 100 may be adjacent to each other, enabling to minimize a transmission path of the vibration.

In some embodiments, the vibration transmitted from the first link 200 may be transmitted to the skin surface in the ear canal through the connection portion 110 and simultaneously to the eardrum through the second link 300. Accordingly, a hybrid sound transmission is enabled, in which a sound transmission through the bone conduction and a sound transmission through the vibration of the eardrum are enabled.

Figure 8A:
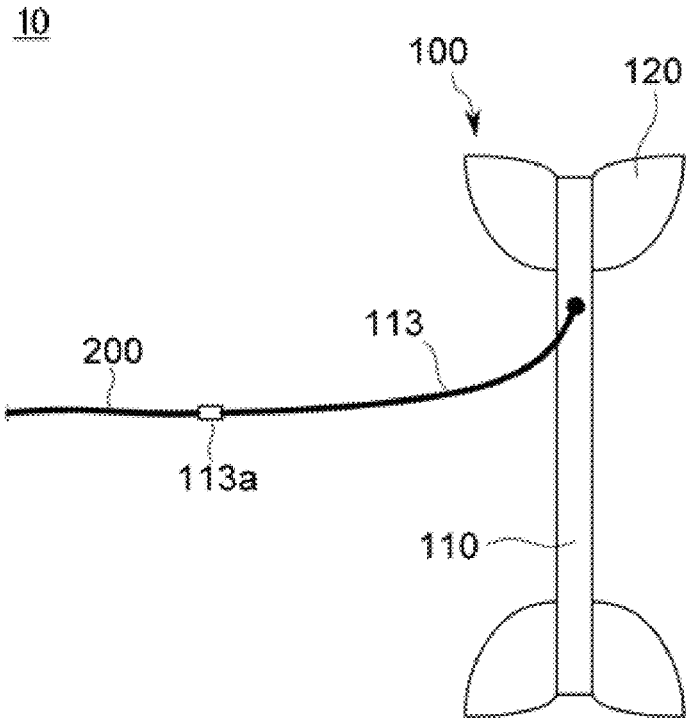
FIGS. 8A and 8B are conceptual diagrams showing a sound anchor having a connection portion further including an extension portion.
Figure 8B:
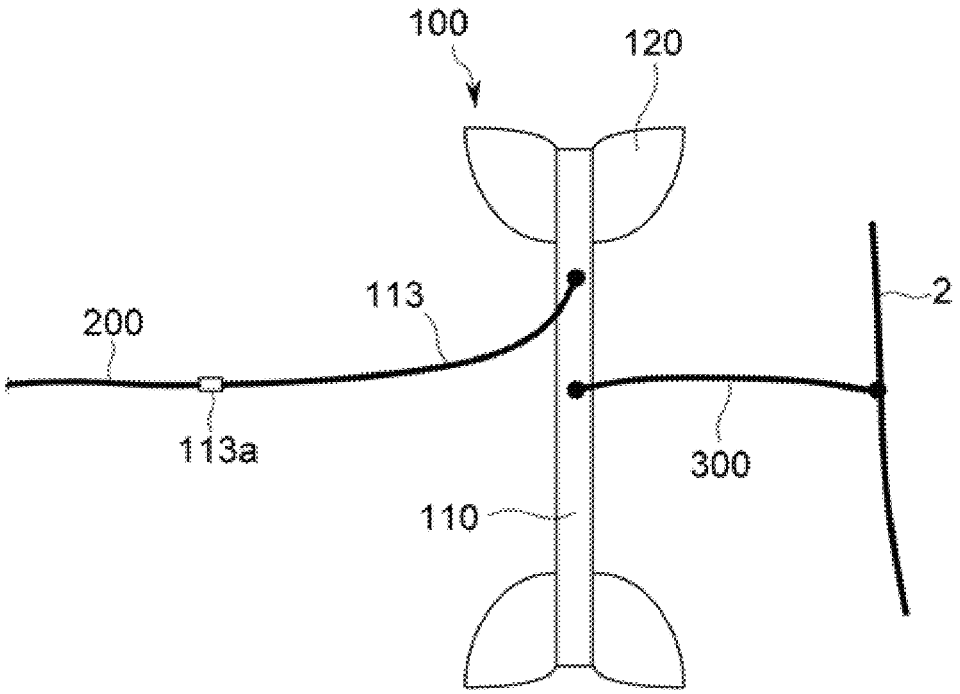

FIGS. 8A and 8B are conceptual diagrams showing a sound anchor having a connection portion further including an extension portion.

Referring to FIGS. 8A and 8B, according to still another embodiment of the present disclosure, an extension portion 113 may be further formed in the connection portion 110.

In the connection portion 110 of each of the anchor 100 described in the first embodiment like FIG. 8A and the anchor 100 described in the second embodiment like FIG. 8B, the extension portion 113 which extends in a direction outside the ear may be further formed in the upper region or lower region of the connection portion 110. The extension portion 113 may be internally formed with the connection portion 110.

One side of the extension portion 113 may be connected to the connection portion 110, and a connection portion 113*a* may be formed on the other side of the extension portion 113. The connection portion may be configured to be attachable to or detachable from the first link 200.

The extension portion 113 is extracted from the anchor 100 toward the outside of the ear canal. Accordingly, the user connects the first link 200 to an end of the extension portion 113 so that the vibration can be transmitted to the anchor 100. As a result, the extension portion 113 facilitates an interconnection for the vibration transmission between the first link 200 and the anchor 100.

Figure 9:
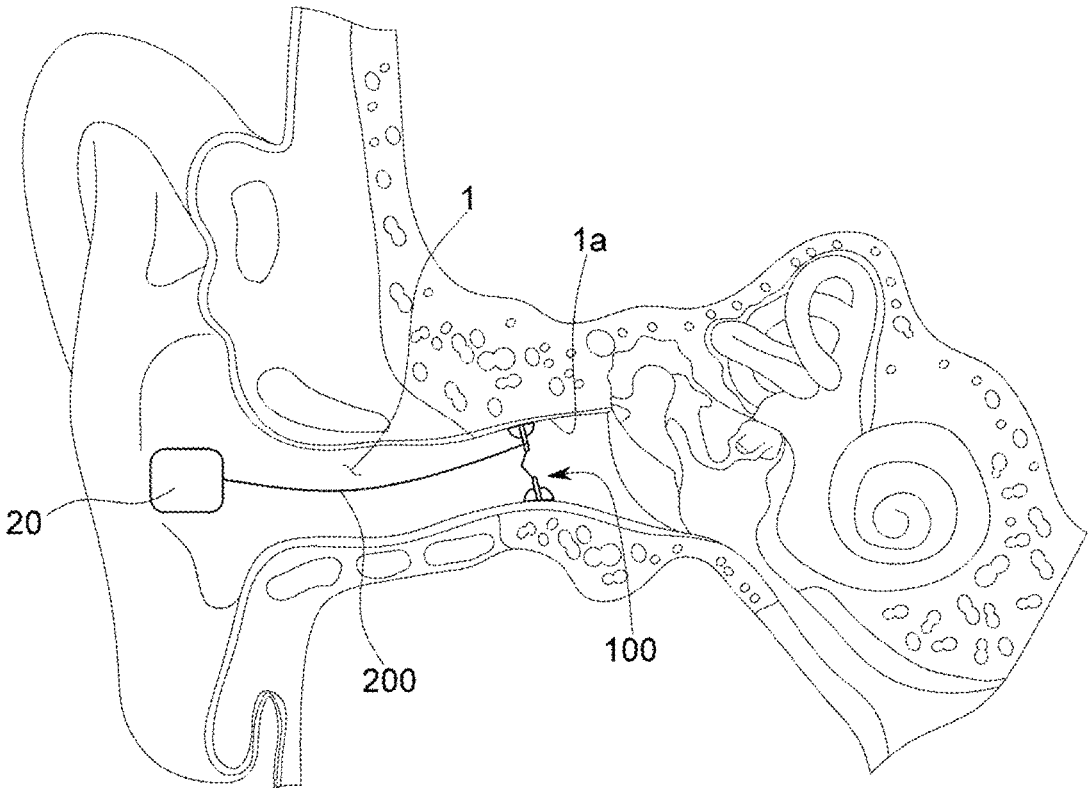
FIG. 9 is a schematic diagram showing the sound anchor installed in the ear canal according to the first embodiment and an external device connected to the sound anchor.
Figure 10:
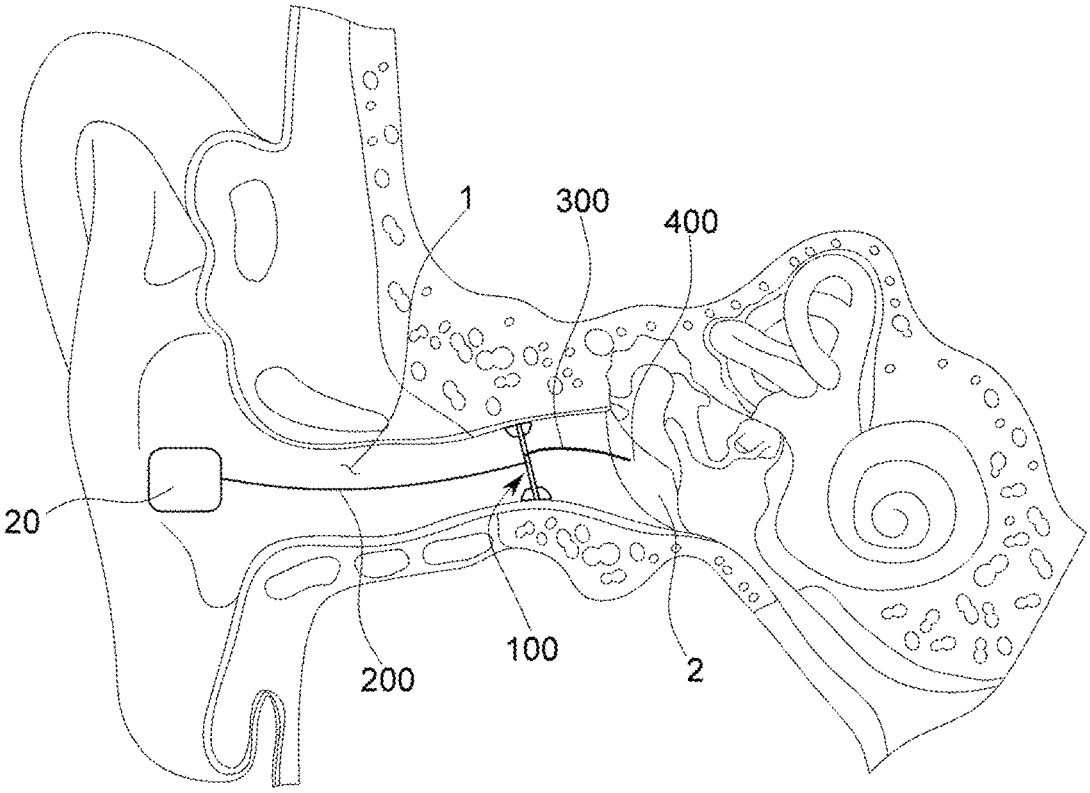
FIG. 10 is a schematic diagram showing the sound anchor installed in the ear canal according to the second embodiment and an external device connected to the sound anchor.

FIG. 9 is a schematic diagram showing the sound anchor installed in the ear canal according to the first embodiment and an external device connected to the sound anchor, and FIG. 10 is a schematic diagram showing the sound anchor installed in the ear canal according to the second embodiment and an external device connected to the sound anchor.

Referring to FIGS. 9 and 10, the sound anchor 10 and the external device 20 may constitute one hearing aid. Here, the hearing aid may function as the bone conduction hearing aid according to the first embodiment, may function as a hearing aid transmitting vibration to the auditory ossicle according to the second embodiment, and may be function as a hybrid hearing aid which transmits the vibration by the bone conduction through the ear canal inner wall and the stimulation of the auditory ossicle.

The external device 20 may be connected to the first link 200.

The sound anchor 10 is installed in the ear canal of the user. The installation of the sound anchor 10 in the ear canal of the user may be accompanied by professional knowledge and surgical experience with respect to human tissues in the ear canal. Therefore, the installation of the sound anchor 10 can be performed by a qualified medical practitioner capable of performing surgery such as a doctor, but the present disclosure is not limited thereto.

The external device 20 may be in various forms such as an earring type external device, an external device inserted in an ear canal, and an external device temporarily attached to the vicinity of the ear.

The external device 20 may include a device for converting a sound into an electric signal, a device for amplifying the converted electric signal, a device for inverting the amplified electric signal to sound, a battery, various circuit devices, or the like, but the present disclosure is not limited thereto.

Moreover, when the user wears the external device 20, the external device 20 and the sound anchor 10 may be connected to each other, and the external device 20 may be detached from the ear. Operations for wearing and detaching the external device 20 may be an operation of attaching or detaching one end of the first link 200 connected to the external device 20 from the anchor 100. That is, the user may wear the external device 200 while inserting the first link 200 extracted from the external device 20 into the ear canal, and, thus, the one end of the first link 200 may be attached to the anchor 100 at the same time as the wearing of the external 20 is completed. Moreover, when the user detaches the external device 20, simultaneously with the detachment, the external device 20 may be detached from the ear of the user while the one end of the first link 200 is detached from the anchor 100.

Meanwhile, the sound anchor 10 is a simple structure which does not have an electronic device and functions to transmit the sound by physical sound and vibration. In addition, the physical sound and vibration are provided by the external device 20. This has the advantage of being free from a problem in battery. Specifically, the sound anchor 10 itself does not require a separate power and thus does not need to have its own battery. Therefore, there is no inconvenience of extracting the sound anchor 10 from the inside of the ear canal for battery charging or replacement.

In addition, the sound anchor 10 is installed in the ear canal in a semi-permanent form, and the external device 20 can be attached to and detached from the sound anchor 10 according to the user's needs. Accordingly, convenience of the hearing aid of the user increases.

In addition, in a state where the external device 20 is removed, the sound anchor 10 is inconspicuous in appearance, and, thus, the convenience of the user increases.

Sound Anchor Having Output Unit

Figure 11A:
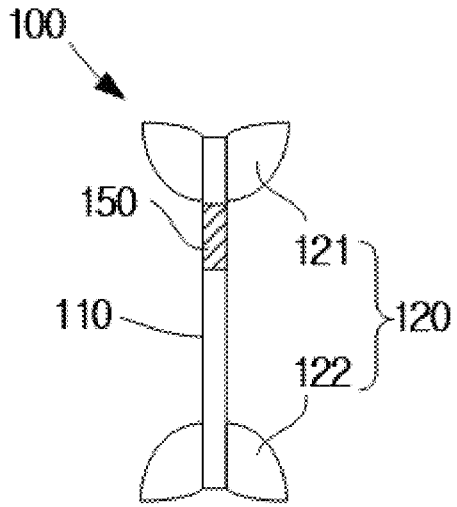
FIGS. 11A and 11B are schematic diagrams showing an anchor constituting a sound anchor according to a third embodiment of the present disclosure.
Figure 11B:
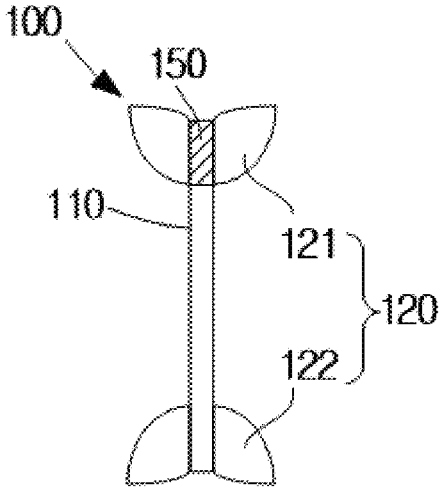
Figure 12:
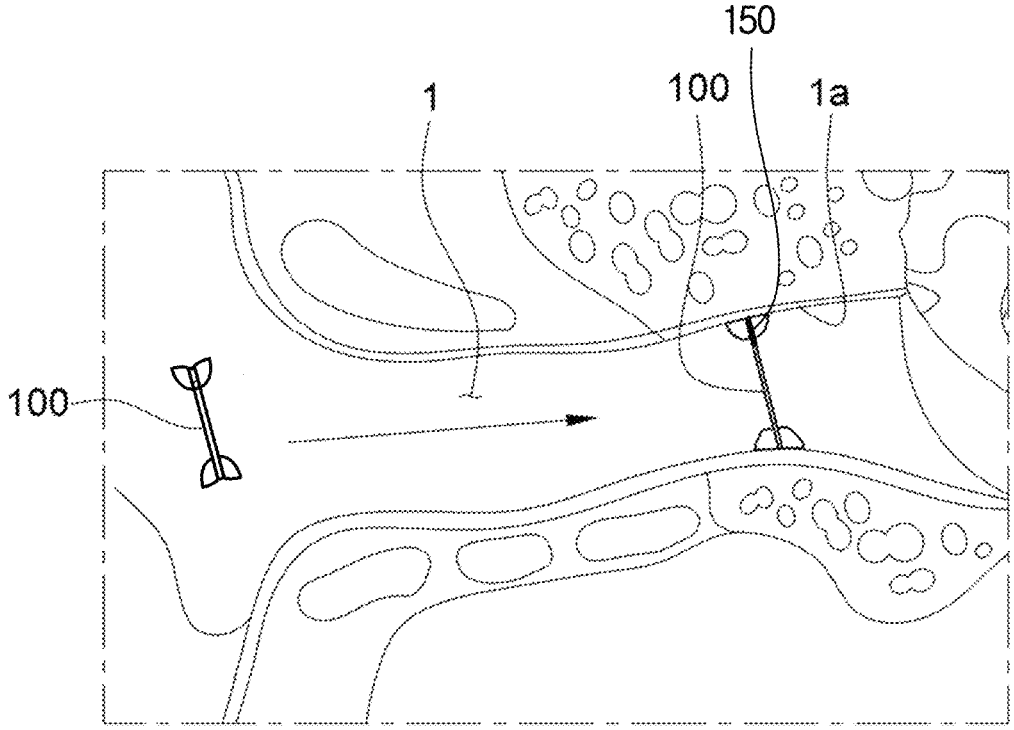
FIG. 12 is a diagram for explaining the sound anchor according to FIGS. 11A and 11B being installed in the ear canal.
Figure 13:
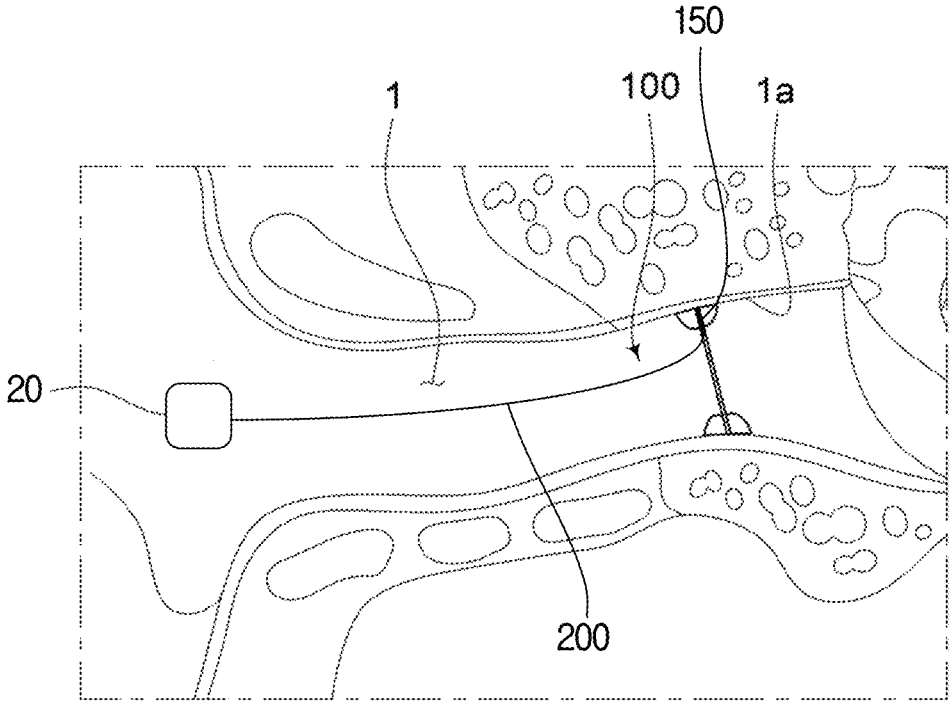
FIG. 13 is a diagram for explaining a connection relationship between an external device and the sound anchor in the ear canal.
Figure 14:
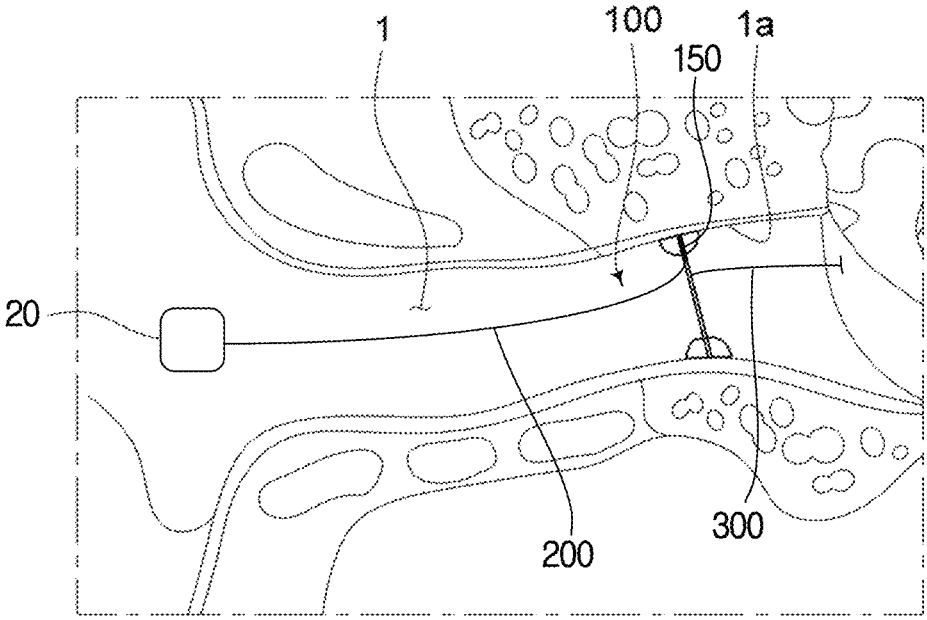
FIG. 14 is a diagram for explaining a sound anchor according to a fourth embodiment of the present disclosure being installed in the ear canal.

FIGS. 11A and 11B are schematic diagrams showing an anchor constituting a sound anchor according to a third embodiment of the present disclosure. FIG. 12 is a diagram for explaining the sound anchor according to FIGS. 11A and 11B being installed in the ear canal, FIG. 13 is a diagram for explaining a connection relationship between an external device and the sound anchor in the ear canal, and FIG. 14 is a diagram for explaining a sound anchor according to a fourth embodiment of the present disclosure being installed in the ear canal.

Referring to FIGS. 11A and 11B, a sound anchor 10 according to the third embodiment of the present disclosure may include an anchor 100 and an output unit 150 installed in the anchor.

The output unit 150 may be a sound element that operates based on a signal received from the outside. According to some embodiments, the output unit 150 may be a speaker or a vibration vibrator which outputs sound based on a signal received from the outside. Moreover, as shown in FIG. 13, the signal may be generated in the external device 20, and the signal may be transmitted from the external device 20 to the anchor 100 through the first link 200. In addition, a power signal for driving the output unit 150 may be received from the external device 20 through the first link 200.

The anchor 100 may include a connection portion 110 and an ear canal contact portion 120. Moreover, as shown in FIG. 11A, the output unit 150 may be installed on the connection portion 110. In some embodiments, as shown in FIG. 11B, the output unit 150 may be installed on an end of the connection portion 110. Moreover, as shown in FIG. 12, when the anchor 100 is installed in an ear canal 1, the output unit 150 may come into contact with a skin surface 1*a* of the ear canal 1. A vibration or sound output from the output unit 150 may be transmitted to a temporal bone facing the skin surface 1*a* through the skin surface 1*a*. As shown in FIG. 7, the vibration or sound output from the output unit 150 may be transmitted through a second link 300 connected to the eardrum and the protrusion of the auditory ossicle.

As shown in FIGS. 11A, 11B, and 12, the anchor 100 has the connection portion 110 and first and second contact portions 121, 122, and the output unit 150 is attached to the connection portion 110. In addition, in FIGS. 11A, 11B, and 12, the anchor 100 is installed in the ear canal. However, the present disclose is not limited thereto, and the output unit 150 may be applied to various anchors described in FIGS. 1A to 1E.

According to the third embodiment, the output unit 150 is installed in the anchor 100. Accordingly, the sound and vibration of the anchor itself can be generated, or the output unit 150 comes into direct contact with the skin surface 1*a* so that the sound and vibration can be transmitted to the skin surface 1*a*. Accordingly, it is possible to precisely and accurately transmit the sound. Moreover, the external device 20 is responsible for signal processing so that the output unit 150 is driven based on the signal from the external device 20. In addition, power for driving the output unit 150 is provided from the external device 20. Accordingly, it is possible to greatly simplify the structure of the sound anchor 10.

Referring to FIG. 14, a sound anchor 10 according to the fourth embodiment of the present disclosure may further include a second link 300. The second link 300 may be fixedly connected to an anchor 100, and a cap of an end of the second link 300 may come into contact with a protrusion region of an eardrum by a short process of a malleus. In addition, a vibration generated by an output unit 150 generates a vibration of the anchor 100, and the vibration can stimulate the short process of the malleus through the second link 300. Accordingly, the vibration of the anchor 100 and the vibration of the cap are generated, and, thus, a hybrid sound transmission capable of performing a stimulation of a bone conduction and a stimulation of an auditory ossicle through the eardrum can be achieved.

Sound Anchor Having Micro-Needle

Figure 15A:
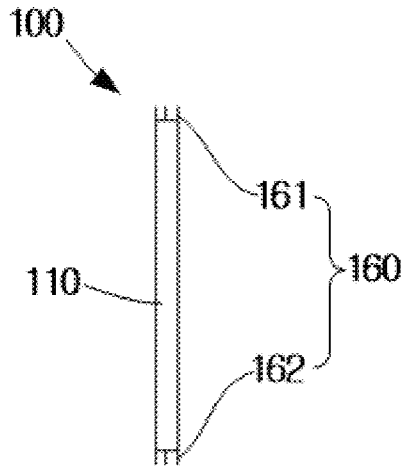
FIGS. 15A, 15B and 15C are schematic diagrams showing a sound anchor according to a fifth embodiment of the present disclosure.
Figure 15B:
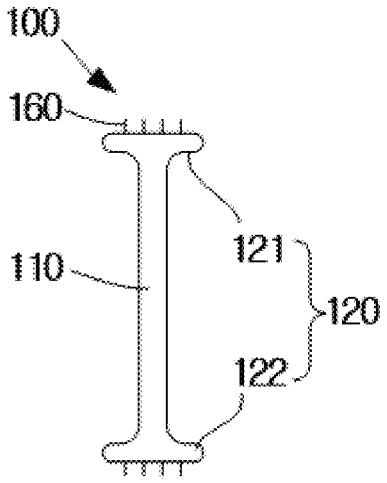
Figure 15C:
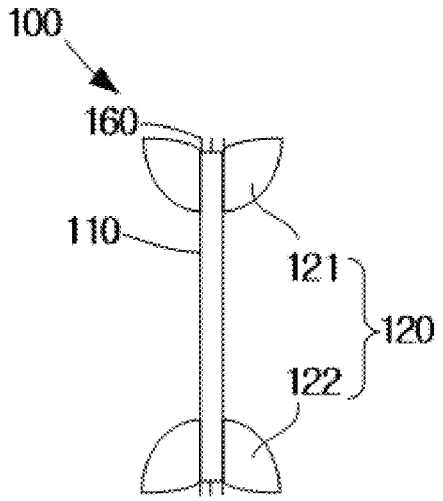
Figure 16:
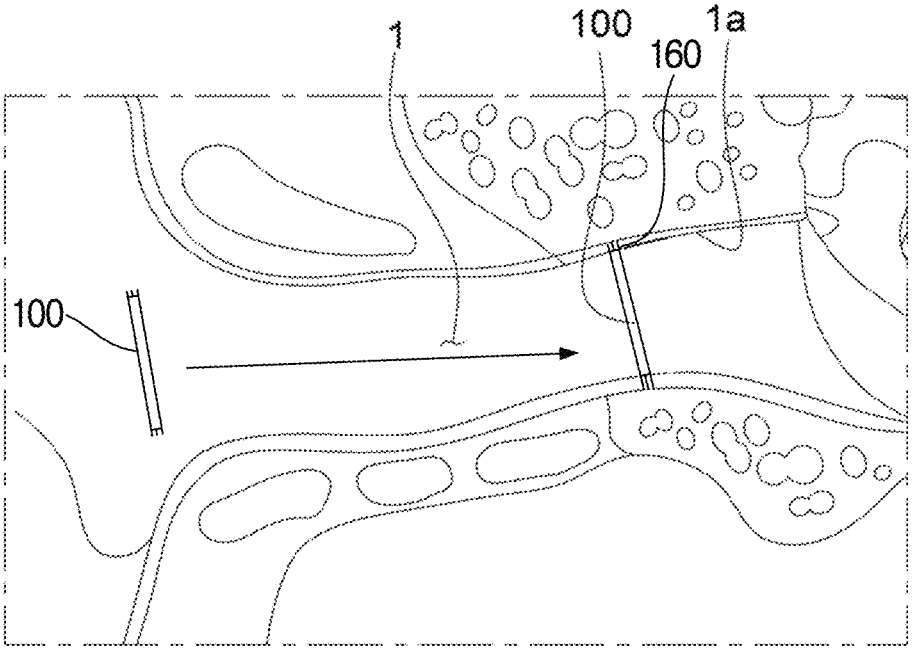
FIG. 16, FIG. 17 and FIG. 18 are diagrams for explaining the sound anchor according to the embodiment shown in FIGS. 15A to 15C being installed in the ear canal.
Figure 17:
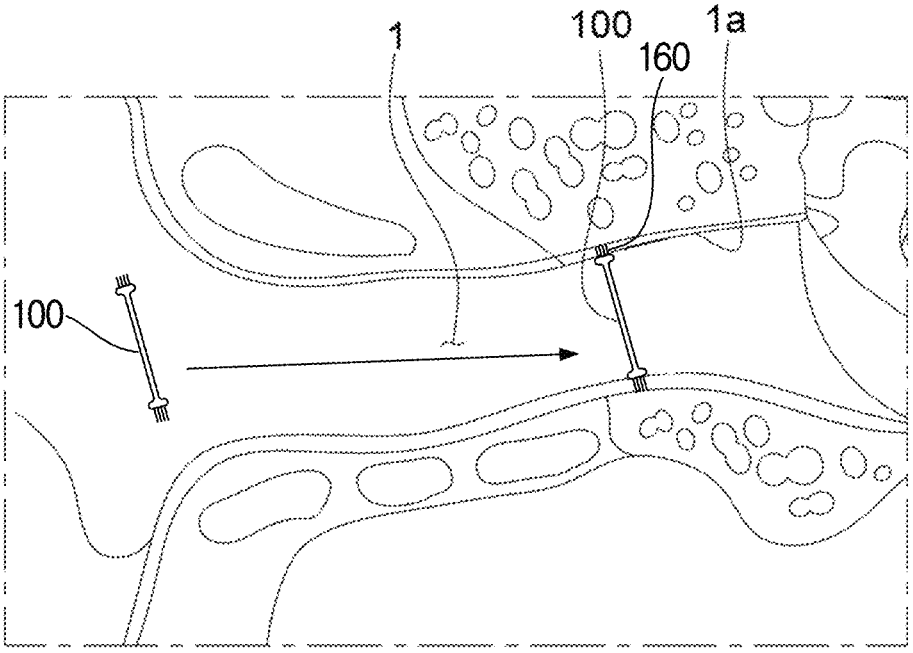
Figure 18:
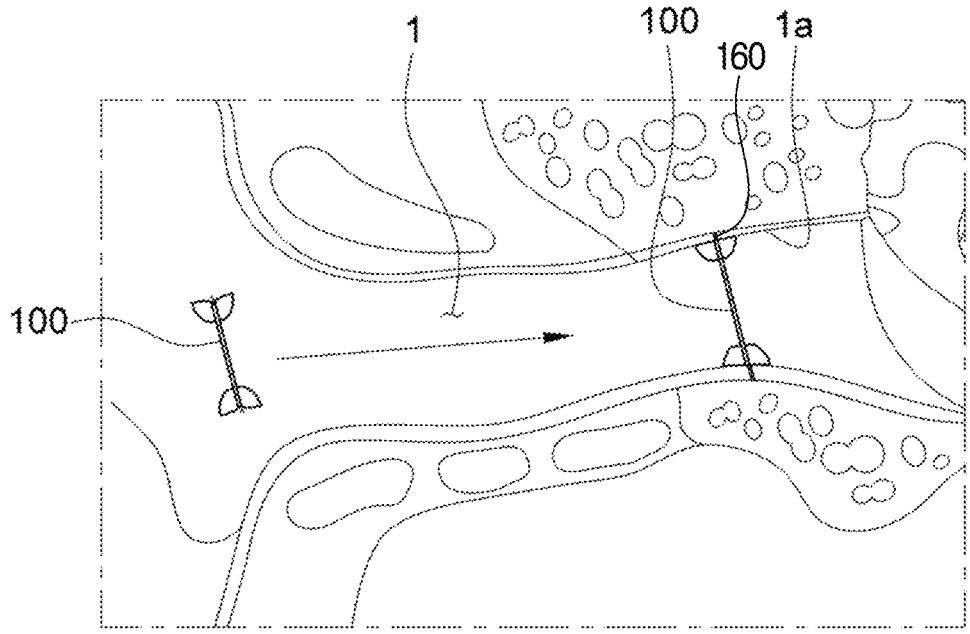
Figure 19:
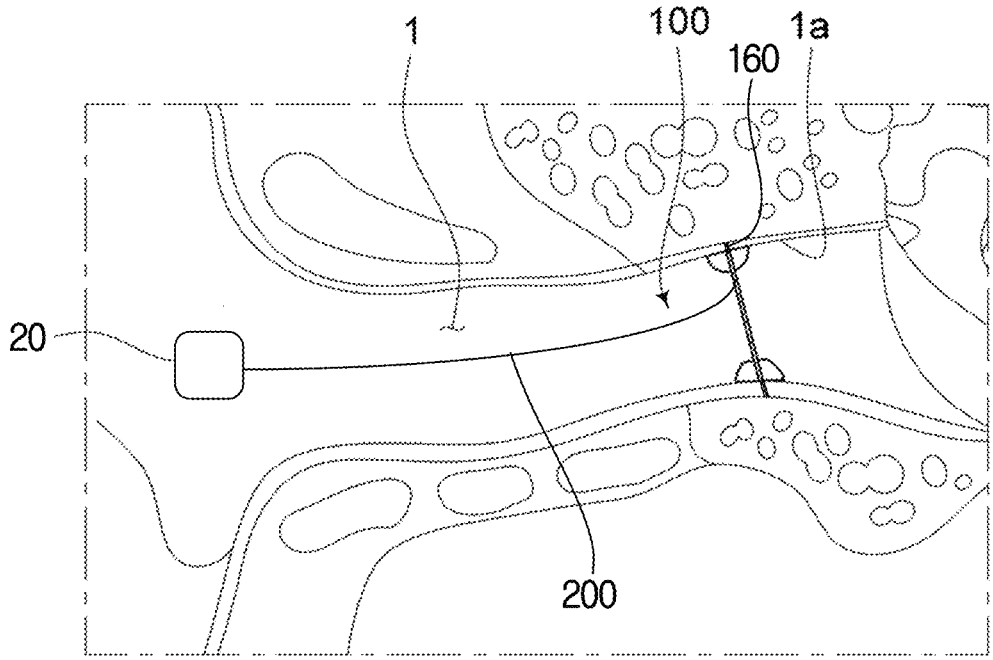
FIG. 19 is a diagram showing a connection relationship between the sound anchor and the external device.
Figure 20:
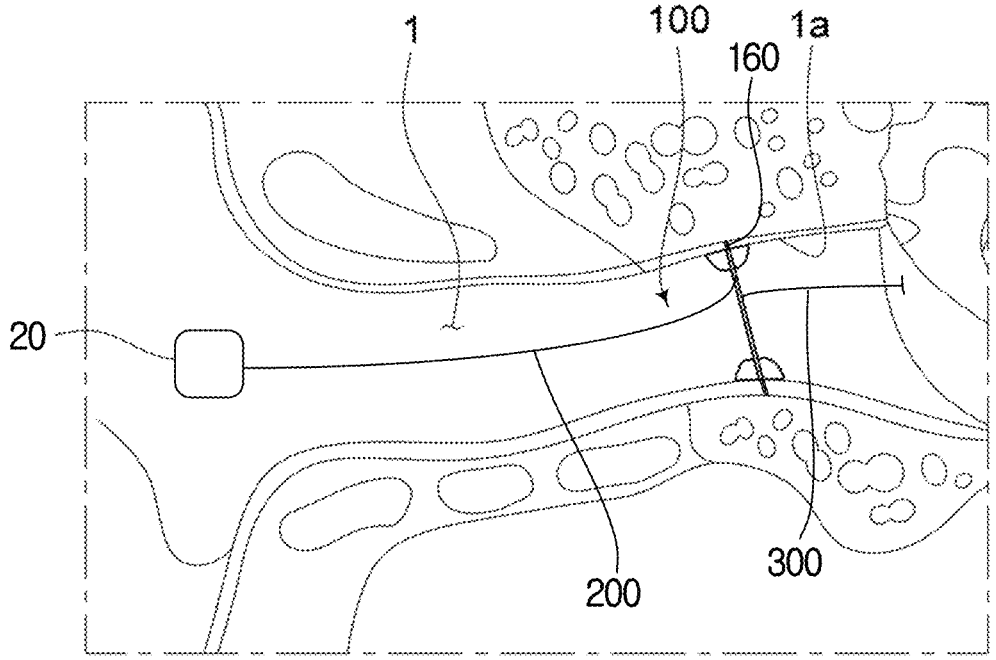
FIG. 20 is a schematic diagram showing a sound anchor according to a sixth embodiment installed in the ear canal.

FIGS. 15A to 15C are schematic diagrams showing a sound anchor according to a fifth embodiment of the present disclosure, and FIGS. 16 to 18 are diagrams for explaining the sound anchor according to the embodiment shown in FIGS. 15A to 15C being installed in the ear canal. In addition, FIG. 19 is a diagram showing a connection relationship between the sound anchor and the external device, and FIG. 20 is a schematic diagram showing a sound anchor according to a sixth embodiment installed in the ear canal.

Referring to FIGS. 15A to 18, an anchor 100 of a sound anchor 10 according to the fifth embodiment of the present disclosure may include micro-needles 160.

Specifically, as shown in FIG. 15A, the anchor 100 may include a connection portion 110 and the micro-needles 160.

The connection portion 110 has a bar shape, first micro-needles 161 may be provided on an upper surface of the connection portion 110, and second micro-needles 162 may be provided on a lower surface of the connection portion 110. However, the present disclosure is not limited thereto, and the micro-needles may be installed only on any one of the upper surface or the lower surface of the connection portion 110. Three or four micro-needles 160 may be provided, but the present disclosure is not limited thereto. In addition, each micro-needle 160 may be configured to have a thickness of approximately 500 micro, but the present disclosure is not limited thereto.

A length of the micro-needle 160 may have a length corresponding to a thickness of a skin layer of a skin surface 1*a* corresponding to a point where the anchor 100 is installed in the ear canal 1.

When the anchor 100 is installed in an ear canal 1, the micro-needles 160 protruding from each of the upper and lower surfaces of the connection portion 110 may penetrate the skin layer so that an end of the micro-needle 160 comes into contact with a temporal bone. The temporal bone is a hard material, and, thus, the anchor 100 is stably supported and fixed in the ear canal 1.

In another aspect, referring to FIG. 15B, the anchor 100 may have a shape such as a capital letter "I" as a whole. That is, first and second contact portions 121 and 122 are respectively provided on both ends of the connection portion 110. The connection portion 110 and an ear canal contact portion 120 may be integrally formed with each other, but the present disclosure is not limited thereto. The micro-needle 160 may be provided in each of the first and second contact portions 121 and 122.

In still another aspect, referring to FIG. 15C, as described in FIG. 1B, the anchor 100 may include the connection portion 110 and the first and second contact portions 121 and 122 which respectively surrounds both edges of the connection portion 110 of the anchor 100. Moreover, the micro-needles 160 may be provided in each of the upper surface and the lower surface of the connection portion 110.

Figure 1E:
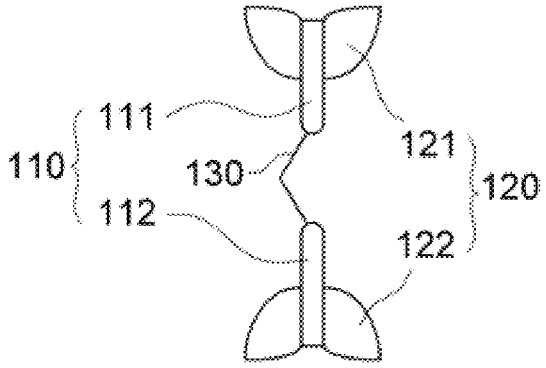

Meanwhile, the anchor 100 may further include a connection portion length adjustment device described in FIGS. 1C, 1D, and 1E.

In the anchor 100 constituting the sound anchor 10 according to the fifth embodiment, a thickness of the micro-needle 160 that penetrates a skin layer and comes into contact with a temporal bone is very thin, and, thus, it is possible to minimize damages of the skin layer. Moreover, the damages of the skin layer are minimized, and, thus, it is possible to prevent side effects such as infection of the skin.

In addition, as shown in FIG. 19, a vibration generated from an external device 20 is transmitted to the connection portion 110 through a first link 200, and this vibration vibrates the micro-needles 160. Moreover, the vibrations of the micro-needles 160 are transmitted to the temporal bone which is in contact with the micro-needles 160. Accordingly, it is possible to directly stimulate the temporal bone, and it is possible to increase efficiency of bone conduction hearing.

Moreover, the length of the micro-needle 160 may be the same as a thickness of the skin layer or may be longer than the thickness of the skin layer at the point where the anchor 100 is installed. Accordingly, when the anchor 100 is installed in the ear canal 1, it is possible to remove a pressure that is applied to the skin surface 1*a* of the ear canal by the anchor 100. Moreover, even when the length of the micro-needle 160 is smaller than the thickness of the skin layer, since the anchor 100 is fixed between the temporal bones facing each other, the pressure applied to the skin layer is smaller compared to the degree that the anchor 100 is fixed between the skin surfaces facing each other. In this way, it is possible to remove or decrease the pressure applied to the skin surface 1*a*, and, thus, it is possible to prevent a pain caused by the pressure applied to the skin when the anchor 100 is installed in the ear canal 1. Moreover, it is possible to also prevent damages of the skin caused by a pressure being continuously applied to a local region of the skin surface 1*a*.

Referring to FIG. 20, a sound anchor 10 according to the sixth embodiment of the present disclosure may further include a second link 300. The second link 300 may be fixedly connected to an anchor 100, and a cap of an end of the second link 300 may be in contact with a protrusion region of an eardrum generated by a short process of a malleus. In addition, a vibration from a first link 20 generates a vibration of the anchor 100, and the vibration can stimulate the short process of the malleus through the second link 300. Accordingly, the vibration of the anchor 100 and the vibration of the cap are generated, and, thus, a hybrid sound transmission capable of performing a stimulation of a bone conduction and a stimulation of an auditory ossicle through the eardrum can be achieved.

Figure 21:
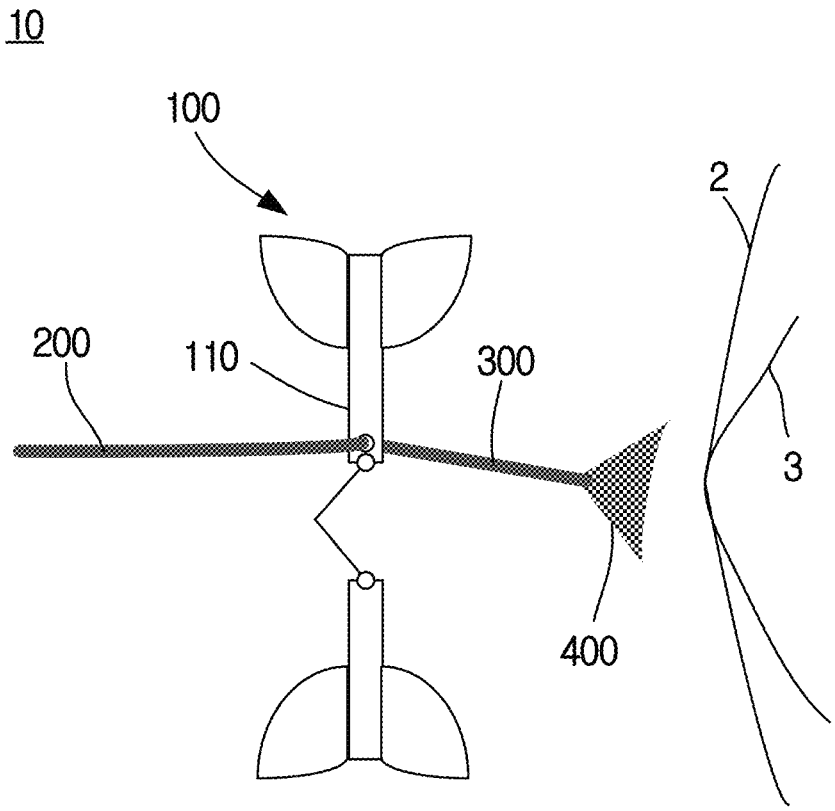
FIG. 21 is a diagram schematically showing a sound anchor according to a seventh embodiment of the present disclosure.
Figure 22A:
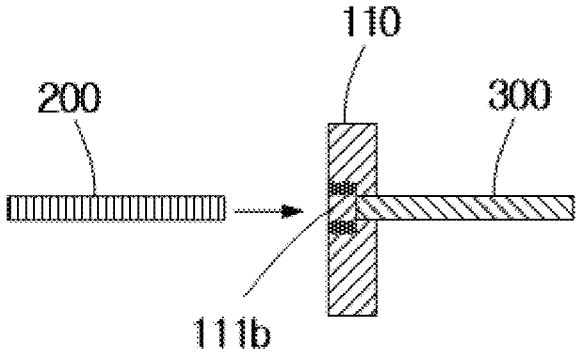
FIGS. 22A, 22B, 22C and 22D are diagrams for explaining the first link being attached to the connection portion.
Figure 22B:
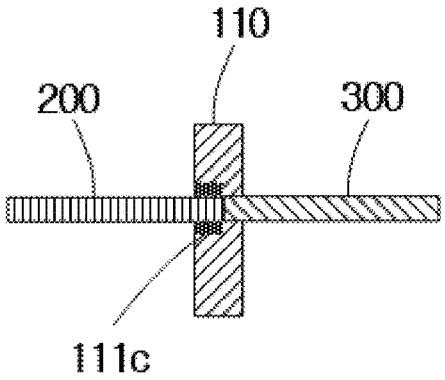
Figure 22C:
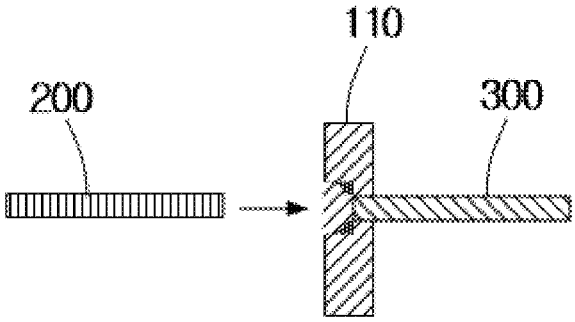
Figure 22D:
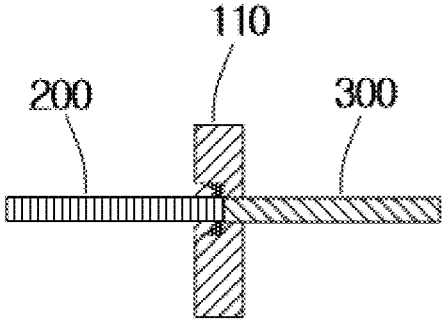

Sound Anchor Capable of Transmitting Sound through First Link and Second Link Constituting One Tube FIG. 21 is a diagram schematically showing a sound anchor according to a seventh embodiment of the present disclosure. In addition, FIGS. 22A to 22D are diagrams for explaining the first link being attached to the connection portion.

Referring to FIG. 21, a sound anchor 10 according to the seventh embodiment may include an anchor 100, a first link 200, and a second link 300.

Each of the first and second links 200 and 300 may have a tubular shape having a hole formed therein.

The second link 300 may be fixedly installed in the anchor 100. In addition, one end of the first link 200 may be attachable to and/or detachable from the anchor 100. In addition, if the one end of the first link 200 is attached to the anchor 100, the first link 200 and the second link 300 may be configured to be connected to each other. The first link 200 and second link 300 may be connected to each other so as to constitute one tube.

The first link 200 and the anchor 100 may be attached to each other through magnetic coupling between the first link 200 and the connection portion 110, but the present disclosure is not limited thereto.

A sound generated from an external device may be transmitted to a cap 400 through the first and second links 200 and 300 constituting one tube. The cap 400 may have a funnel shape, but the present disclosure is not limited thereto. That is, any shape may be used as long as the sound transmitted through the second link 300 can be transmitted to the entire protrusion region by the short process of the malleus in the region of the eardrum.

In addition, the cap 400 may be maintained to be spaced apart from the protrusion region by a predetermined distance, but the present disclosure is not limited thereto. That is, the cap 400 may come into contact with the protrusion region to cover the protrusion region.

Referring to FIGS. 22A to 22D, a hole 111*b* may be formed in the connection portion 110. One end of the first link 200 may be inserted into one side of the hole 111*b*, and one end of the second link 300 may be inserted into the other side of the hole 111*b*. The second link 300 may be fixedly installed in the connection portion 110 in a state where the one end of the second link 300 is inserted into the hole 111*b*. Moreover, the attachment between the first link 200 and the connection portion 110 may be described as the one end of the first link 200 being inserted into the hole 111*b*. A magnetic body and/or a magnetic material 111*c* may be formed in an area of an outer circumferential surface of the hole 111*b* into which the one end of the first link 200 is inserted. Accordingly, when the one end of the first link 200 approaches the connection portion 110, one end of the first link 200 may be inserted into the hole 111*b* by an attraction between the one end of the first link 200 and the magnetic body and/or the magnetic material 111*c*. In addition, if the one end of the first link 200 is inserted into the hole 111*b*, the first and second links 200 and 300 together constitute one tube.

According to some embodiments, as the one side of the hole 111*b* of the first link 200 enters the inside of the hole 111*b*, a circumference of hole may be narrowed. Moreover, the circumference of the hole 111*b* may be narrowed to a circumference of an inner tube of the second link 300. Accordingly, one peripheral surface of the hole 111*b* into which the first link 200 enters may be a predetermined inclination surface. Therefore, if the one end of the first link 200 approaches the hole 111*b*, the one end of the first link 200 is attracted to the hole 111*b* side by the magnetic body and/or the magnetic material 111*c* on the connection portion 110, and, thus, the one end of the first link 200 can be easily inserted into the hole 111*b* by the inclination surface of the hole 111*b*. In addition, the one end of the first link 200 inserted into the hole 111*b* is connected to the second link 300, and, thus, the first link 200 and the second link 300 can form one tube.

A sound generated through the external device may be transmitted to the eardrum and the auditory ossicle through the first and second links 200 and 300 and the cap 400. In addition, the sound stimulates the protrusion region of the region of the eardrum generated by the short process of the malleus, and, thus, efficiency of the sound transmission increases. Moreover, the first link 200 connected to the external device can be attached to or detached from the anchor 100, and the anchor 100 and the second link 300 are maintained in the ear canal. Accordingly, the sound generated from the external device can be directly transmitted to the eardrum or can be transmitted to the vicinity of the eardrum only by connecting the first link 200 to the anchor 100.

The specific implementations described in the present disclosure are examples and do not in any way limit the scope of the present disclosure. For brevity of the specification, descriptions of electronic configurations, control systems, software, and other functional aspects of the systems in the related art may be omitted. In addition, connections of lines between the components shown in the drawings or connection members show by way of example show functional connections and/or physical or circuit connections, and in a practical device, may be represented as a replaceable or additional various functional connections, physical connections, or circuit connections. In addition, unless otherwise stated, "essential" or "important" may not indicate a necessary component for the application of the present disclosure.

In addition, in detailed descriptions of the present disclosure, preferred embodiments of the present disclosure are described as examples. However, those skilled in the art or those of ordinary skill in the art will understand that the present disclosure can be variously modified and changed within a scope which does not depart from the spirit and technical scope of the present disclosure described in the claims below. Accordingly, the technical scope of the present disclosure should not be limited to the details set forth in the specification, but should be defined by the claims.

The invention claimed is:

1. A sound anchor for transmitting a sound and vibration to human tissues in an ear canal of a user, the sound anchor comprising:

a first link; and an anchor configured to be fixed to an ear canal inner wall of a user, wherein the anchor receives the sound and vibration from the first link and transmits the sound and vibration to at least one of an ear canal bone portion, a bone portion skin surface, and an auditory ossicle protruded portion of an eardrum, wherein the anchor includes a bar-shaped connection portion and an ear canal contact portion connected to the connection portion, the ear canal contact portion includes a first contact portion connected to one end portion of the connection portion and in contact with the skin surface or the bone portion, and a second contact portion connected to the other end portion of the connection portion and in contact with the skin surface or the bone portion, and the first link is attachable to or detachable from the anchor.

2. The sound anchor of claim 1, wherein the sound and vibration are directly transmitted to the bone portion in the ear canal facing the skin surface.

3. The sound anchor of claim 2, wherein the connection portion includes a first connection portion to which the first contact portion is connected, a second connection portion to which the second contact portion is connected, and a connection portion length adjustment device that connects the first connection portion and the second connection portion, and the connection portion length adjustment device provides a restoring force when a length of the connection portion is contracted to fix the anchor to the ear canal.

4. The sound anchor of claim 3, wherein the connection portion length adjustment device includes a spring that is attachable to or detachable from the first and second connection portions.

5. The sound anchor of claim 3, wherein the first link is attachable to or detachable from the first connection portion or the second connection portion.

6. The sound anchor of claim 2, wherein each of the first and second contact portions is made of an elastic material, the first contact portion is located to surround the one end portion of the connection portion in a state where an upper surface of the connection portion is exposed, the second contact portion is located to surround the other end portion of the connection portion in a state where a lower surface of the connection portion is exposed, and when the anchor is installed in the ear canal inner wall, the first and second contact portions are transformed according to a shape of the ear canal inner wall such that each of the upper surface and the lower surface of the connection portion comes into contact with the skin surface.

7. The sound anchor of claim 2, wherein one end of the first link is attachable to or detachable from the anchor through magnetic coupling and decoupling.

8. The sound anchor of claim 7, wherein the first link includes a 1-1th link and a 1-2nd link, the 1-2nd connecting the 1-1th link and the anchor, and when the first link is inserted into the ear canal, the 1-2nd link is flexible to be bent by attraction according to the magnetic coupling.

9. The sound anchor of claim 7, wherein the connection comprises a groove portion that accommodates the one end of the first link and is magnetically coupled to the one end of the first link.

10. The sound anchor of claim 1, further comprising:

a second link that receives the sound and vibration from the anchor and transmits the sound and vibration to the eardrum and an auditory ossicle of the user, wherein one end of the second link is in contact with the eardrum, and the other end of the second link is connected to the anchor.

11. The sound anchor of claim 10, wherein the one end of the second link is in contact with a protruded region in a surface region of the eardrum, the protruded region being protruded by a short process of a malleus of the auditory ossicle.

12. The sound anchor of claim 11, wherein a cap is installed in the one end of the second link, the cap having a shape corresponding to the protruded region and covering the protruded region.

13. The sound anchor of claim 12, wherein the first link and the second link are connected to each other and constitute one tube.

14. The sound anchor of claim 10, wherein the sound and vibration transmitted from the first link is transmitted to a skin surface in the ear canal bone portion of the user via the anchor through bone conduction to provide bone conduction auditory acuity, and the sound and vibration transmitted from the anchor is transmitted to the eardrum and auditory ossicle via the second link to provide auditory acuity generated by a vibration of the auditory ossicle.

15. The sound anchor of claim 1, the anchor further comprising an output unit that is provided in the connection portion, generates the sound or vibration based on a signal from the first link, and outputs the sound or vibration to the bone portion.

16. The sound anchor of claim 1, the anchor further comprising a micro-needle provided on one side and/or the other side of the connection portion, wherein the micro-needle penetrates a skin layer in the ear canal to come into contact with a temporal bone corresponding to the penetrated skin layer, and the sound and vibration transmitted from the first link are transmitted to the temporal bone via the connection portion and the micro-needle.

17. A sound anchor for transmitting a sound and vibration to human tissues in an ear canal of a user, the sound anchor comprising:

a first link; and an anchor configured to be fixed to an ear canal inner wall of a user and connected to the first link, wherein the anchor includes a bar-shaped connection portion and a micro-needle which is provided on one side and/or the other side of the connection portion, the micro-needle penetrates a skin layer in the ear canal to come into contact with a temporal bone corresponding to the penetrated skin layer, a sound and vibration transmitted from the first link are transmitted to the temporal bone via the connection portion and the micro-needle, and the first link is attachable to or detachable from the anchor.

* * * * *